US012546168B2

(12) United States Patent
Hanna et al.

(10) Patent No.: US 12,546,168 B2
(45) **Date of Patent: *Feb. 10, 2026**

(54) SUPPORT FOR DRILLING AND BOLTING TOOL

(71) Applicant: Joy Global Underground Mining LLC, Warrendale, PA (US)

(72) Inventors: Peter Hanna, Stanwell Tops (AU); Daniel Plumb, Fairy Meadow (AU); Callum Tyler, Sudbury (CA)

(73) Assignee: JOY GLOBAL UNDERGROUND MINING LLC, Warrendale, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/761,219

(22) Filed: Jul. 1, 2024

(65) Prior Publication Data

US 2024/0352798 A1 Oct. 24, 2024

Related U.S. Application Data

(63) Continuation of application No. 17/903,532, filed on Sep. 6, 2022, now Pat. No. 12,025,003.

(60) Provisional application No. 63/241,517, filed on Sep. 7, 2021.

(51) Int. Cl.
*E21B 7/02* (2006.01)
*E21B 15/00* (2006.01)

(52) U.S. Cl.
CPC ..... *E21B 7/025* (2013.01); *E21B 7/022* (2013.01); *E21B 15/006* (2013.01)

(58) Field of Classification Search
CPC ..... E21B 7/024; E21B 7/022; E21B 15/006
See application file for complete search history.

(56) References Cited

U.S. PATENT DOCUMENTS

| | | | |
|---|---|---|---|
| 2,581,667 | A | 1/1952 | Joy |
| 2,690,896 | A | 10/1954 | Bissell et al. |
| 3,061,023 | A | 10/1962 | Samhammer et al. |
| 3,172,782 | A | 3/1965 | Jache |
| 3,207,044 | A | 9/1965 | Hall |
| 3,218,893 | A | 11/1965 | Madison et al. |
| 3,316,983 | A | 5/1967 | Goodman |

(Continued)

FOREIGN PATENT DOCUMENTS

| | | | |
|---|---|---|---|
| AU | 2006235837 | A1 | 11/2006 |
| EP | 434652 | A1 | 6/1991 |

(Continued)

OTHER PUBLICATIONS

Sandvik, "Sandvik DL331-5 Underground Drill Rig," Technical Specification 7-6360-A, Jul. 26, 2011, 4 pages.

(Continued)

*Primary Examiner* — Nathaniel C Chukwurah
(74) *Attorney, Agent, or Firm* — Husch Blackwell LLP

(57) ABSTRACT

A boom for supporting a drilling and bolting tool includes a first portion, a second portion, an actuator for moving the second portion relative to the first portion in a direction parallel to the longitudinal axis. The second portion includes an elongated shaft having a proximal end and a distal end, the proximal end supported by a shaft support for movement relative to the first portion in a direction parallel to the longitudinal axis, the distal end configured to support the drilling and bolting tool.

20 Claims, 22 Drawing Sheets

(56) References Cited

U.S. PATENT DOCUMENTS

| | | | | |
|---|---|---|---|---|
| 3,404,920 | A | 10/1968 | Tabor | |
| 3,439,925 | A | 4/1969 | Sampson | |
| 3,840,128 | A | 10/1974 | Swoboda et al. | |
| 3,849,995 | A | 11/1974 | Jamison | |
| 3,920,084 | A | 11/1975 | Russell, Jr. | |
| 4,158,520 | A | 6/1979 | Prebensen | |
| 4,215,953 | A | 8/1980 | Perraud | |
| 4,217,987 | A | 8/1980 | Gattu et al. | |
| 4,258,853 | A | 3/1981 | Gill et al. | |
| 4,300,594 | A | 11/1981 | Bacardit | |
| 4,344,599 | A | 8/1982 | Herron | |
| 4,441,761 | A | 4/1984 | Fields et al. | |
| 4,498,544 | A | 2/1985 | Molin | |
| 5,310,011 | A * | 5/1994 | Kaakkurivaara | E21B 15/04 173/28 |
| 5,954,143 | A | 9/1999 | Mccabe et al. | |
| 6,105,684 | A | 8/2000 | Pointer et al. | |
| 8,061,449 | B2 | 11/2011 | Haglund | |
| 8,950,822 | B2 | 2/2015 | Niederriter et al. | |
| 9,580,966 | B2 * | 2/2017 | Rudinec | E21B 7/025 |
| 10,683,753 | B2 | 6/2020 | Hanna et al. | |
| 11,203,933 | B2 | 12/2021 | Hanna et al. | |
| 12,025,003 | B2 * | 7/2024 | Hanna | E21D 20/003 |
| 2003/0205547 | A1 | 11/2003 | Dupre et al. | |
| 2007/0068583 | A1 | 3/2007 | Johnson et al. | |
| 2009/0044645 | A1 | 2/2009 | Buescher | |
| 2011/0042116 | A1 * | 2/2011 | Voimanen | E21B 7/025 173/190 |
| 2014/0251726 | A1 * | 9/2014 | Ditty | B66C 13/12 182/69.4 |
| 2015/0218946 | A1 * | 8/2015 | Vogel | E21D 20/003 405/259.1 |
| 2017/0114594 | A1 * | 4/2017 | Anttonen | E21B 6/00 |
| 2018/0010454 | A1 * | 1/2018 | Holdsworth | E21B 7/027 |
| 2018/0119492 | A1 * | 5/2018 | Nelson | E21B 7/025 |
| 2019/0178082 | A1 * | 6/2019 | Hanna | E21D 20/003 |
| 2022/0002428 | A1 | 1/2022 | Wu et al. | |

FOREIGN PATENT DOCUMENTS

| | | | |
|---|---|---|---|
| EP | 525186 | A1 | 2/1993 |
| EP | 3059382 | A1 | 8/2016 |
| WO | 2019048093 | A1 | 3/2019 |
| WO | 2019048094 | A1 | 3/2019 |

OTHER PUBLICATIONS

International Preliminary Report on Patentability for Application No. PCT/US2018/065553 dated Jun. 25, 2020 (11 pages).

International Search Report and Written Opinion for Application No. PCT/US2018/065553 dated Mar. 6, 2019 (16 pages).

European Patent Office Extended Search Report for Application No. 18887821.9 dated Jul. 23, 2021 (9 pages).

European Patent Office Action for Related Application No. 22194281.6 dated Feb. 2, 2023 (7 pages).

Canadian Examination Report for Application No. 3172782 dated Feb. 5, 2024 (3 pages).

Chilean Second Substantive Report for Application 202202428 dated Jul. 25, 2024 (3 pages).

* cited by examiner

SUPPORT FOR DRILLING AND BOLTING TOOL

REFERENCE TO RELATED APPLICATIONS

The present application is a continuation of co-pending U.S. patent application Ser. No. 17/903,532, filed Sep. 6, 2022, claims the benefit of U.S. Patent Application No. 63/241,517, filed Sep. 7, 2021. The entire contents of these applications are incorporated by reference.

FIELD

The present disclosure relates to drill rigs, such as a drilling and bolting tool for forming a hole and/or inserting a bolt into a hole in a rock surface.

Drilling and bolting rigs may include an extendable frame and a drive unit movable along the frame for inserting a drill bit or bolt into a rock surface. Components of a drilling and bolting rig are typically actuated by fluid power (e.g., hydraulic power), requiring complicated fluid power systems as well as fluid conduits or hoses to be connected to the drilling and bolting rig.

SUMMARY

In one independent aspect, a boom for supporting a drilling and bolting tool includes a first portion including a first end, a second end, and a longitudinal axis extending between the first end and the second end; a second portion including an elongated shaft having a proximal end and a distal end, the proximal end supported by a shaft support for translational movement relative to the first portion in a direction parallel to the longitudinal axis, the distal end configured to support the drilling and bolting tool; an actuator for moving the second portion relative to the first portion in a direction parallel to the longitudinal axis; a guide track; and a guide member for engaging the track, the guide member positioned on one of the first portion and the second portion, the guide member extending in a radial direction and inhibiting rotation of the shaft support about the longitudinal axis.

In some aspects, the guide member includes a spherical bearing for engaging the guide track.

In some aspects, the actuator includes a hydraulic cylinder, an end of the hydraulic cylinder coupled to the guide member, wherein actuation of the hydraulic cylinder is operable to cause translational movement of the second portion relative to the first portion in the direction parallel to the longitudinal axis.

In some aspects, the first portion includes a housing having a cylindrical portion and a rectangular portion positioned radially outward of the cylindrical portion, wherein the elongated shaft is positioned within the cylindrical portion, and wherein the guide track and guide member are positioned within the rectangular portion.

In some aspects, the guide member includes a spherical bearing positioned within the rectangular portion and engaging the guide track.

In some aspects, the boom further includes: a rotary flow distributor positioned within the first portion and in fluid communication with a fluid source; and a plurality of conduits extending between the rotary flow distributor and the distal end of the second portion, the plurality of conduits extending through the shaft support and the elongated shaft.

In some aspects, the plurality of conduits are configured to provide communication between a first end of the first portion and the drilling and bolting tool.

In some aspects, the guide member is secured to the shaft support by an interference fit.

In some aspects, the shaft support includes a slot having a wedge surface, wherein the guide member includes a wedge surface engaging the wedge surface of the slot in the interference fit, and the guide member is secured by at least one fastener passing through a portion of the shaft support.

In some aspects, the guide member is further retained within the slot of the shaft support by a retaining block positioned adjacent an end of the guide member.

In another independent aspect, a boom for supporting a drilling and bolting tool includes a first portion including a first end, a second end, and a longitudinal axis extending between the first end and the second end; a second portion including a proximal end and a distal end, the proximal end supported for translational movement relative to the first portion in a direction parallel to the longitudinal axis, the distal end configured to support the drilling and bolting tool; a support portion supporting the second portion for movement relative to the first portion; a plurality of passages extending at least between the distal end and the proximal end; and a torsion member extending between the proximal end and the distal end and transmitting torque between the proximal end and the distal end, the torsion member reducing a torque exerted on the passages.

In some aspects, the torsion member includes a tube extending between the proximal end and the distal end, wherein the plurality of passages are positioned within the tube.

In some aspects, the boom further includes: a rotary flow distributor positioned adjacent one of the proximal end and the distal end of the second portion, the rotary flow distributor including a rotatable portion and a non-rotatable portion, wherein the torsion member is secured to the non-rotatable portion.

In some aspects, the plurality of passages extend between the distal end and the first end of the first portion.

In some aspects, the boom further includes: a rotary flow distributor positioned within the first portion and in fluid communication with a fluid source, a portion of the rotary flow distributor being rotatable with the second portion, wherein the plurality of passages extend between the rotary flow distributor and the distal end of the second portion, the plurality of conduits extending through the second portion and the support portion.

In some aspects, the boom further includes: a rotary flow distributor positioned within the second portion and in fluid communication with a fluid source, a portion of the rotary flow distributor being rotatable with the second portion, wherein the plurality of passages extend between the rotary flow distributor and the first end of the first portion, the plurality of conduits extending through the second portion and the support portion.

In some aspects, the boom further includes: a pair of guide tracks extending along an inside of the first portion and engaging an outside of the support portion to inhibit rotation of the support portion relative to the first portion.

In some aspects, the pair of guide tracks are positioned on opposite sides of the support portion.

In some aspects, the boom further includes: a flow distributor secured to the distal end of the second portion, the flow distributor configured to support the drilling and bolting tool.

In some aspects, the boom further includes: an extension cylinder positioned within the first portion and receivable within the second portion, the extension cylinder including a hydraulic actuator operable to extend the distal end of the second portion away from the first portion and the hydraulic actuator.

In yet another independent aspect, a boom for supporting a drilling and bolting tool includes: a first portion including a first end, a second end, and a longitudinal axis extending between the first end and the second end; a second portion including a proximal end and a distal end, the proximal end supported for translational movement relative to the first portion in a direction parallel to the longitudinal axis, the distal end configured to support the drilling and bolting tool; and a flexible cable positioned within the second portion and coupled between the first portion and the second portion.

In some aspects, the boom further includes a cable guide supporting the flexible cable and controlling the bending of the cable as the second portion moves relative to the first portion.

In some aspects, a first end of the cable guide chain is fixed relative to the first portion and a second end of the cable guide chain is fixed relative to the second portion.

In some aspects, the cable guide chain is slidably retained within a cable guide bracket.

In some aspects, the boom further includes a support portion supporting the second portion for movement relative to the first portion.

In some aspects, at least a portion of the flexible cable is a spirally coiled cable.

Other aspects will become apparent by consideration of the detailed description and accompanying drawings.

DETAILED DESCRIPTION

Before any embodiments are explained in detail, it is to be understood that the disclosure is not limited in its application to the details of construction and the arrangement of components set forth in the following description or illustrated in the following drawings. The disclosure is capable of other embodiments and of being practiced or of being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Unless specified or limited otherwise, the terms "mounted," "connected," "supported," and "coupled" and variations thereof are used broadly and encompass both direct and indirect mountings, connections, supports, and couplings.

In addition, it should be understood that embodiments may include hardware, software, and electronic components or modules that, for purposes of discussion, may be illustrated and described as if the majority of the components were implemented solely in hardware. However, one of ordinary skill in the art, and based on a reading of this detailed description, would recognize that, in at least one embodiment, aspects may be implemented in software (for example, stored on non-transitory computer-readable medium) executable by one or more processing units, such as a microprocessor, an application specific integrated circuits ("ASICs"), or another electronic device. As such, it should be noted that a plurality of hardware-based and software-based devices, as well as a plurality of different structural components may be utilized to implement the disclosure. For example, "controllers" described in the specification may include one or more electronic processors or processing units, one or more computer-readable medium modules, one or more input/output interfaces, and various connections (for example, a system bus) connecting the components.

Figure 1:
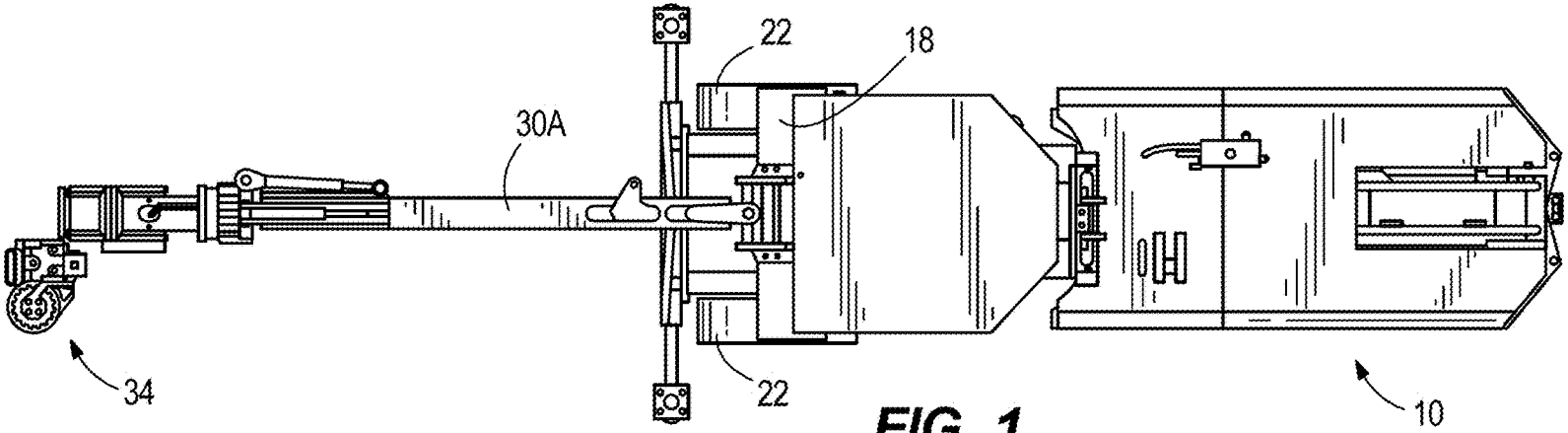
FIG. 1 is a plan view of a mobile machine.
Figure 2:
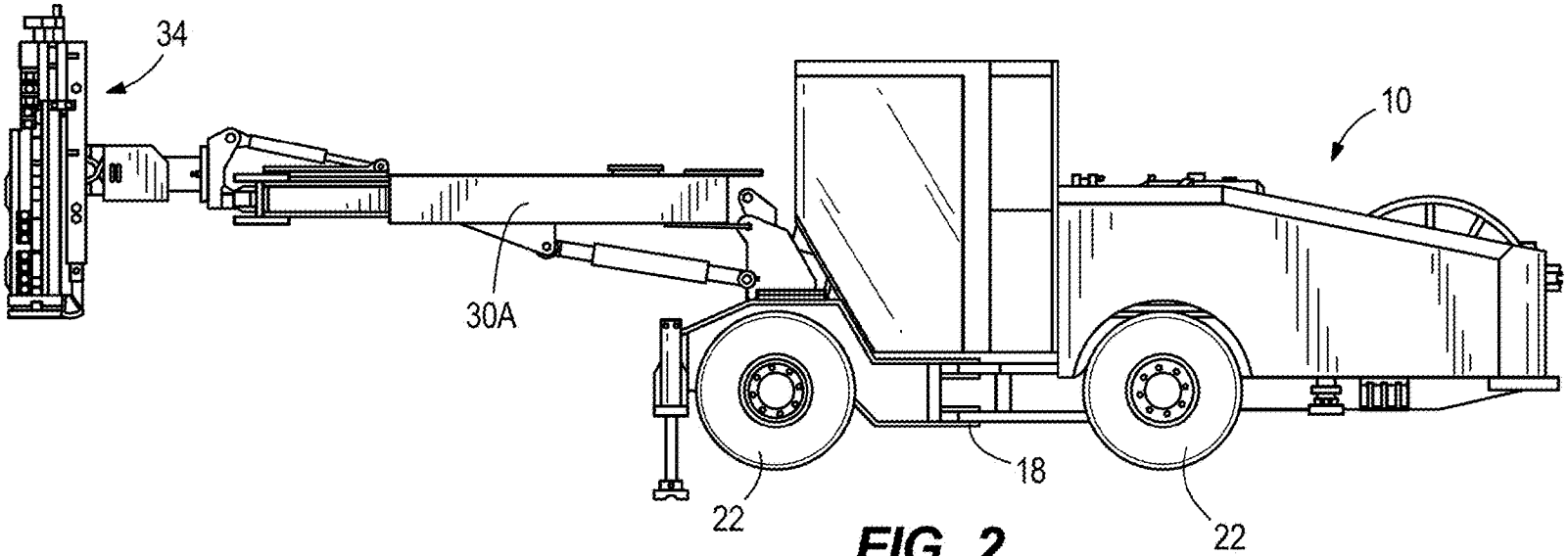
FIG. 2 is a side view of the mobile machine of FIG. 1.

FIGS. 1 and 2 illustrate a mobile mining machine 10, such as a drill jumbo or bolting machine. In the illustrated embodiment, the machine 10 includes a frame or chassis 18 supported by traction drive members 22 (e.g., wheels), and a support member or boom 30A coupled to the chassis 18. The boom 30A supports a drilling and bolting rig, or drill tool 34, for forming holes in a mine surface (e.g., a roof, a floor, or a rib or side wall—not shown) and/or installing a drill element (e.g., a bit or a bolt—not shown). In the illustrated embodiment, the drill tool 34 performs both drilling and bolting operations. Among other things, an installed bolt may anchor or support a safety mesh (not shown) to protect personnel against rock that may fall or become dislodged from the mine surface. In other embodiments, the drill tool 34 may be mounted on another type of mining machine, such as a continuous mining machine (not shown). In some embodiments, the machine may include multiple booms, each of the booms supporting a drilling and bolting rig.

Figure 3:
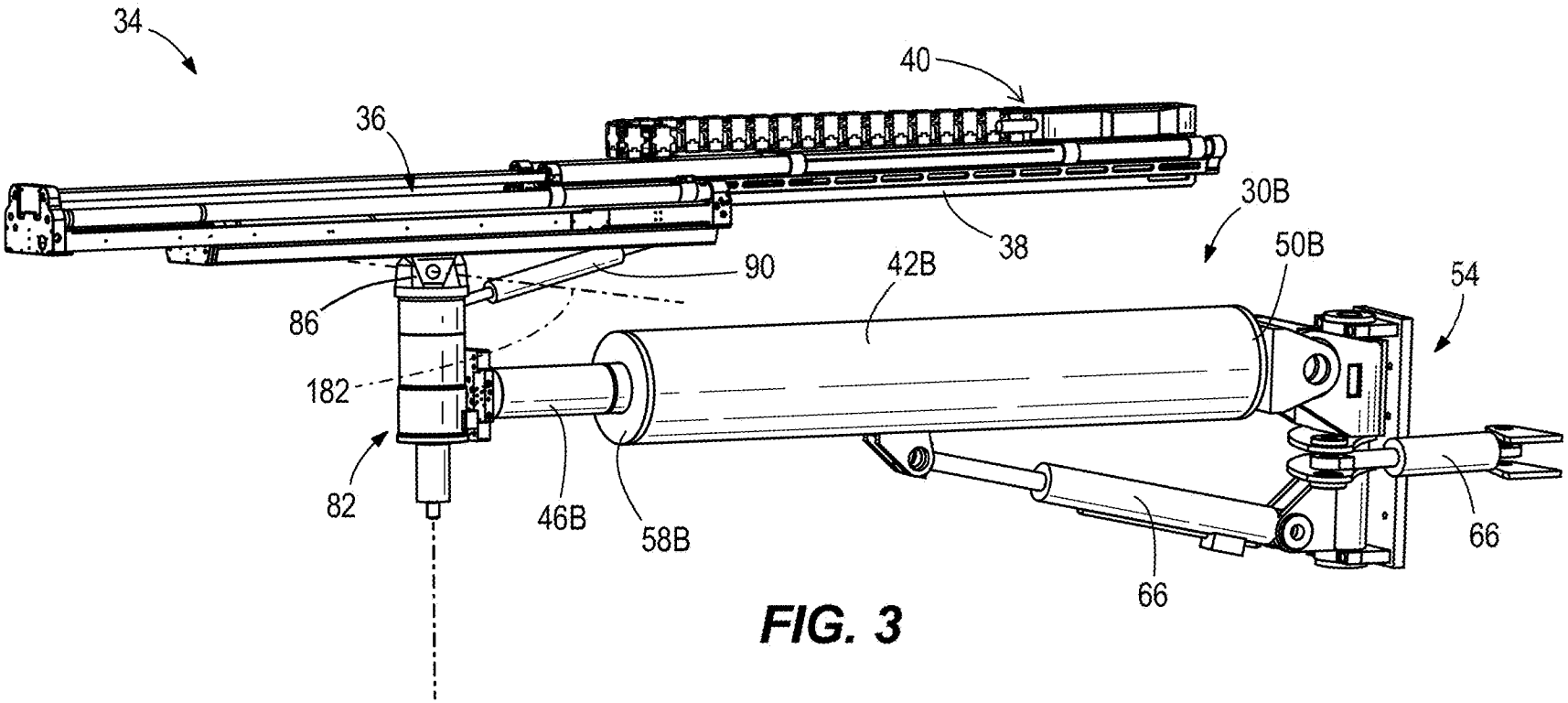
FIG. 3 is a perspective view of a drilling and bolting tool and a boom supporting the drilling and bolting tool.

Referring to FIG. 3, the drill tool 34 includes a base frame 36, a feed frame 38 supported for telescoping movement relative to the base frame 36, and a drive unit 40 for driving a bit or a bolt. In the illustrated embodiment, the drive unit is a drifter that includes both rotation and percussion in driving the bit. In other embodiments, the drive unit 40 may include a rotation unit. The drive unit 40 is movable along the feed frame 38 and the base frame 36 to drive the bit or bolt into a rock surface. In some embodiments, the drill tool 34 may be similar to the drilling and bolting tool described in U.S. patent application Ser. No. 16/219,756, filed Dec. 13, 2017, the entire contents of which are hereby incorporated by reference.

Figure 4:
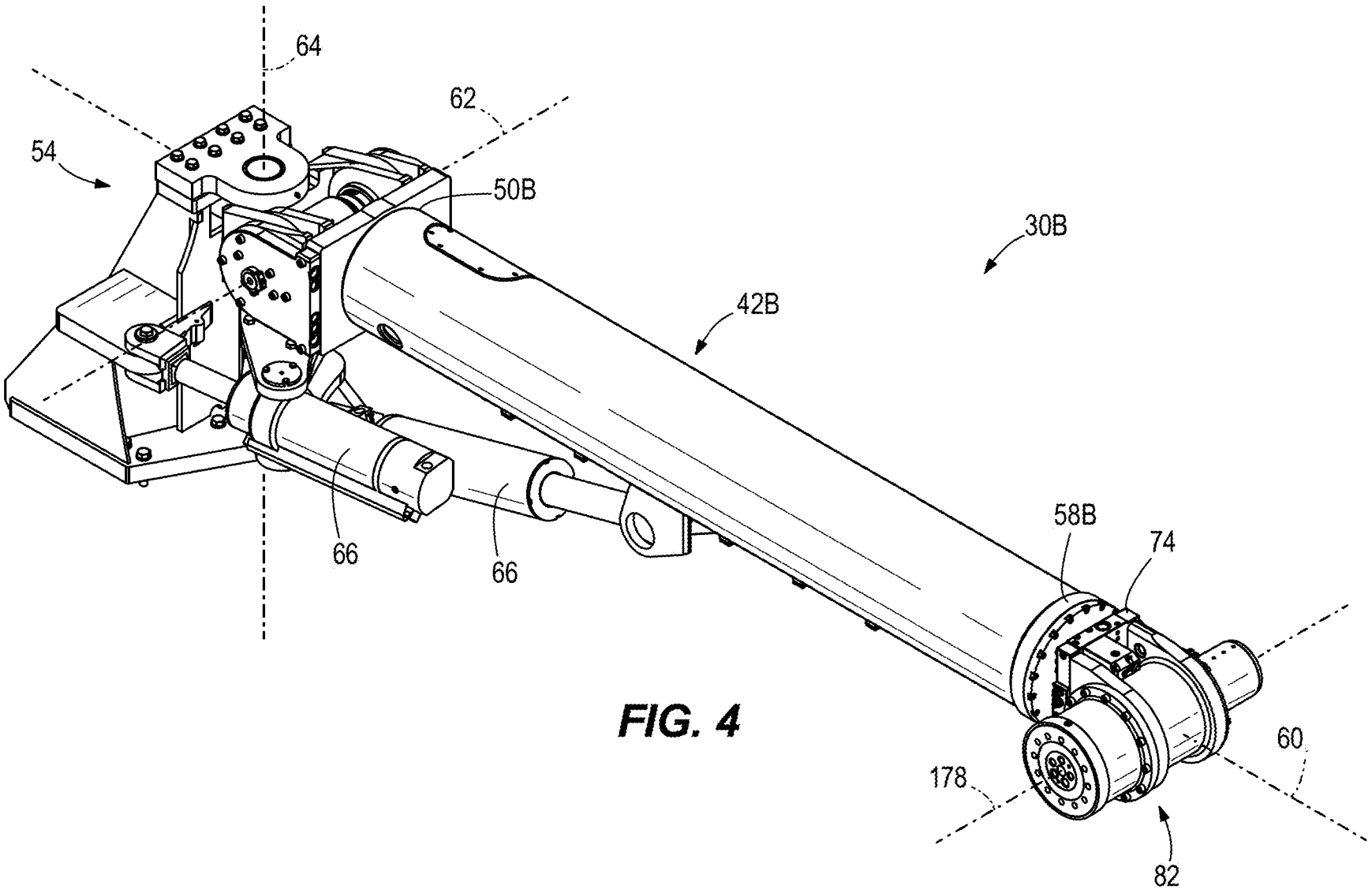
FIG. 4 is perspective view of the boom of FIG. 3.

FIGS. 3 and 4 illustrate a boom 30B according to one embodiment. The boom 30B includes an elongated housing 42B and a shaft 46B (FIG. 3) supported for movement relative to the housing 42B. The housing 42B includes a first end 50B (e.g., which is coupled to a chassis of the machine 10) and a second end 58B opposite the first end 50B. A housing axis 60 extends between the first end 50B and the second end 58B. In some embodiments, the second end 58B includes a bearing to support the shaft 46B for translational movement relative to the housing 42B. The first end 50B can be supported on a bracket or carrier 54 to permit pivoting about multiple axes (e.g., a first axis 62 and a second axis 64—FIG. 4), and the housing 42B can be driven by actuators 66 (e.g., fluid cylinders) to pivot about the axes 62, 64.

Figure 5:
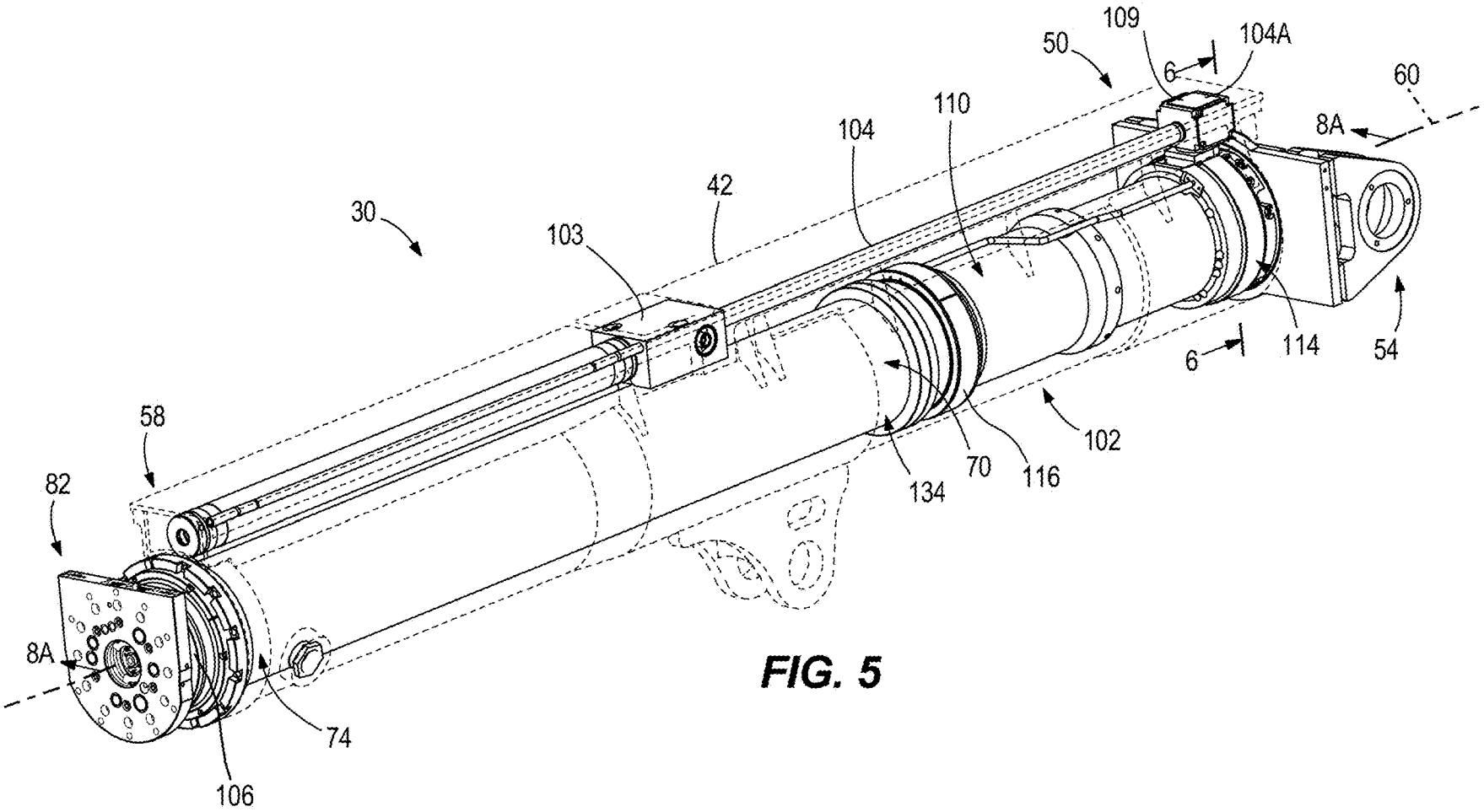
FIG. 5 is a perspective view of a boom according to an exemplary embodiment, with a housing shown in broken lines.

FIG. 5 illustrates a boom 30 according to an exemplary embodiment. The boom 30 includes a housing 42 and a shaft 46 supported for movement relative to the housing 42. The housing 42 includes a first end 50 and a second end 58 opposite the first end 50. A housing axis 60 extends between the first end 50 and the second end 58. The first end 50 can be supported in a similar manner as boom 30B described above with respect to FIGS. 3 and 4.

In the illustrated embodiment, the housing 42 has a hollow cylindrical shape, and the shaft 46 is movable to extend and retract relative to the housing 42 in a telescoping manner. A proximal end 70 of the shaft 46 is supported within the housing 42, while a distal end 74 is positioned beyond the second end 58 of the housing 42. The distal end 74 may support a drill tool 34 (FIG. 3), and the distal end 74 may be coupled to and support a combined actuator and flow distributor 82 (FIG. 3) that in turn is coupled to and supports the drill tool 34. The drill tool 34 is coupled to the combined actuator and flow distributor 82 (e.g., by a pin joint 86—FIG. 3), and an actuator 90 may pivot the drill tool 34 about an end of the combined actuator and flow distributor 82.

Figure 6:
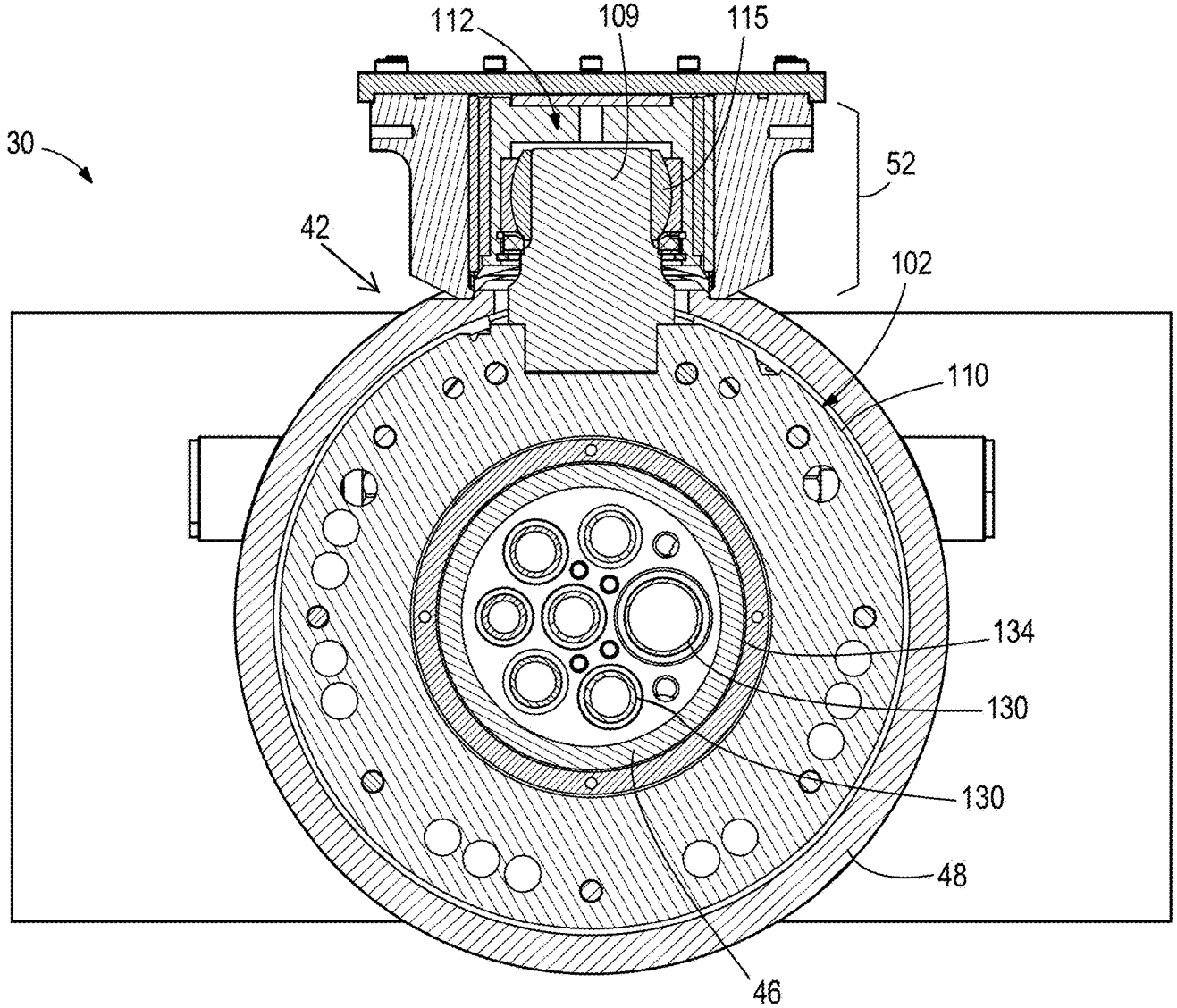
FIG. 6 is a section view of the boom of FIG., viewed along section 6-6.
Figure 8A:
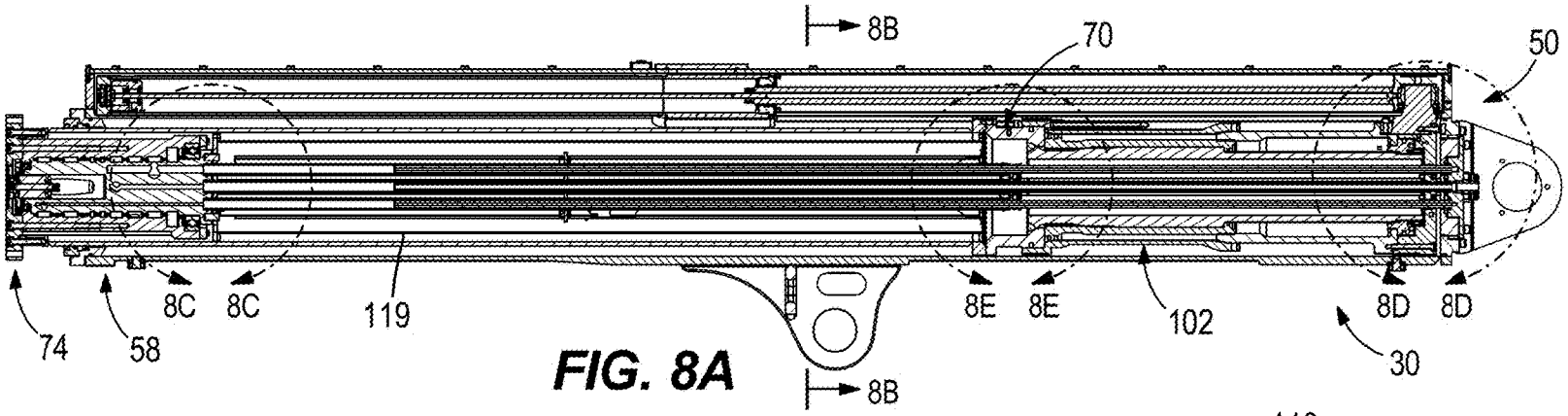
FIG. 8A is a section view of the boom of FIG. 5, viewed along a length of the boom.
Figure 8C:
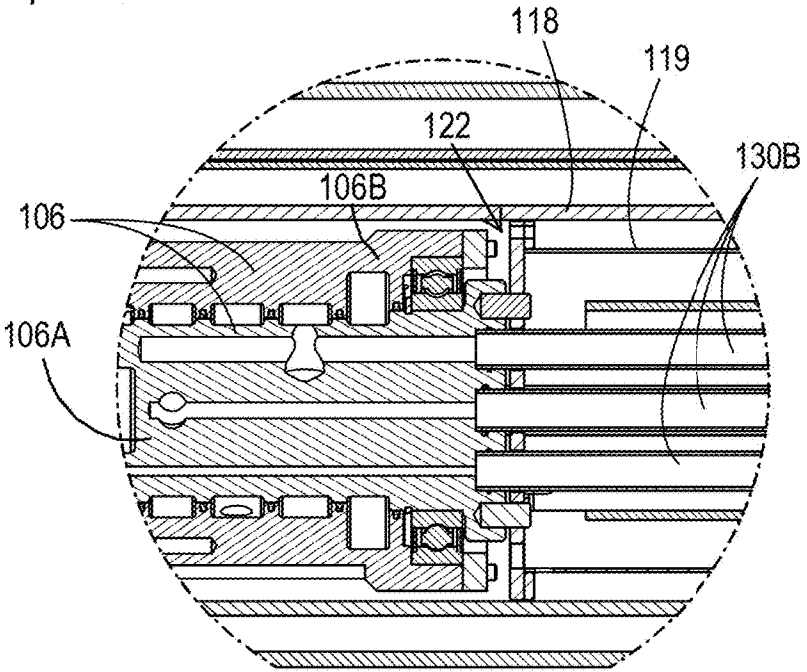
FIG. 8C is a detail view of the section view of FIG. 8A near a second end of the boom.
Figure 8B:
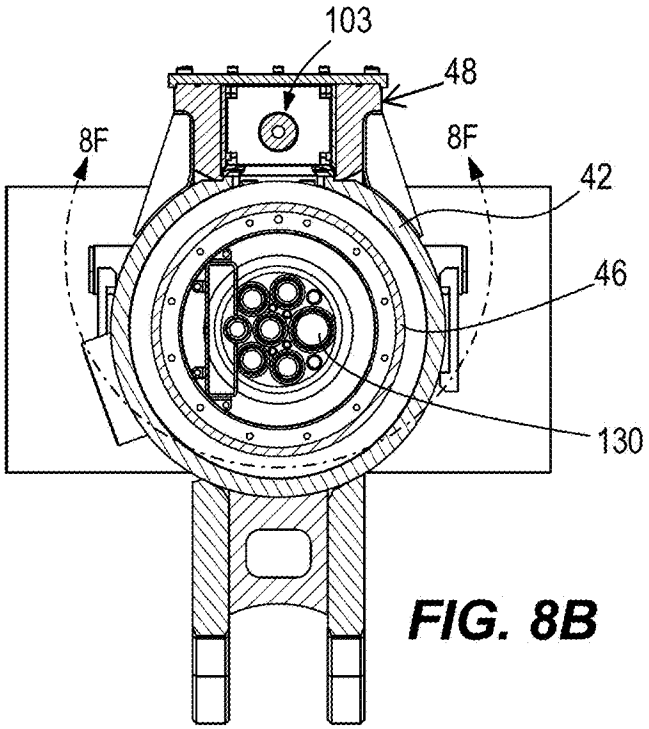
FIG. 8B is a section view of the boom of FIG. 8A, viewed along section 8B-8B.
Figure 8E:
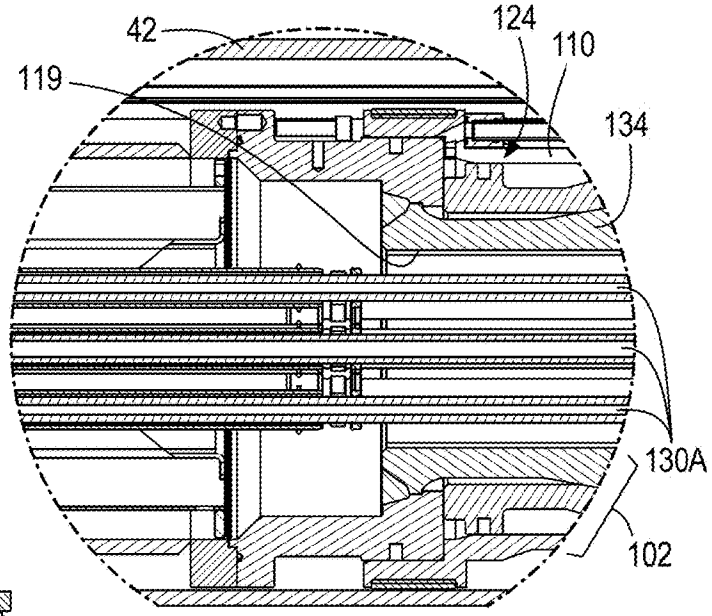
FIG. 8E is a detail view of the section view of FIG. 8A near a proximal end of the shaft.
Figure 8F:
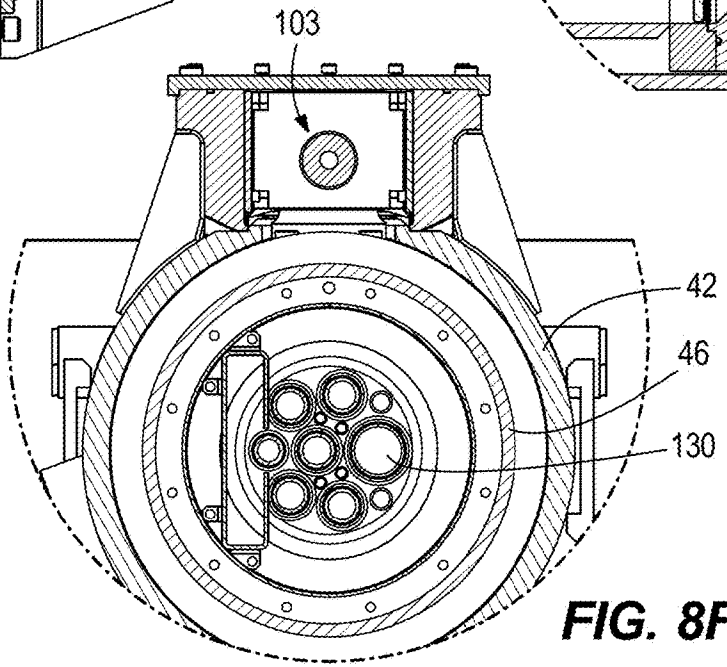
FIG. 8F is a detail view of the section view in FIG. 8B.
Figure 8D:
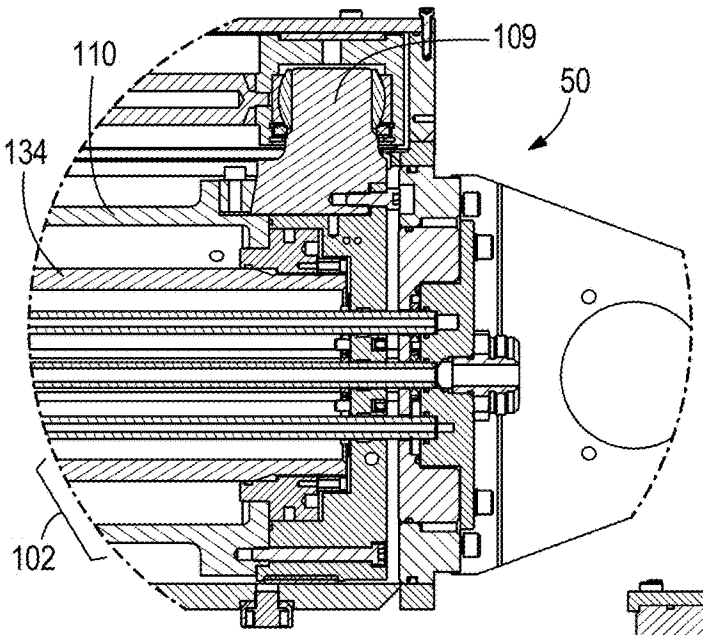
FIG. 8D is a detail view of the section view of FIG. 8A near an end of the shaft support and a first end of the boom.
Figure 9A:
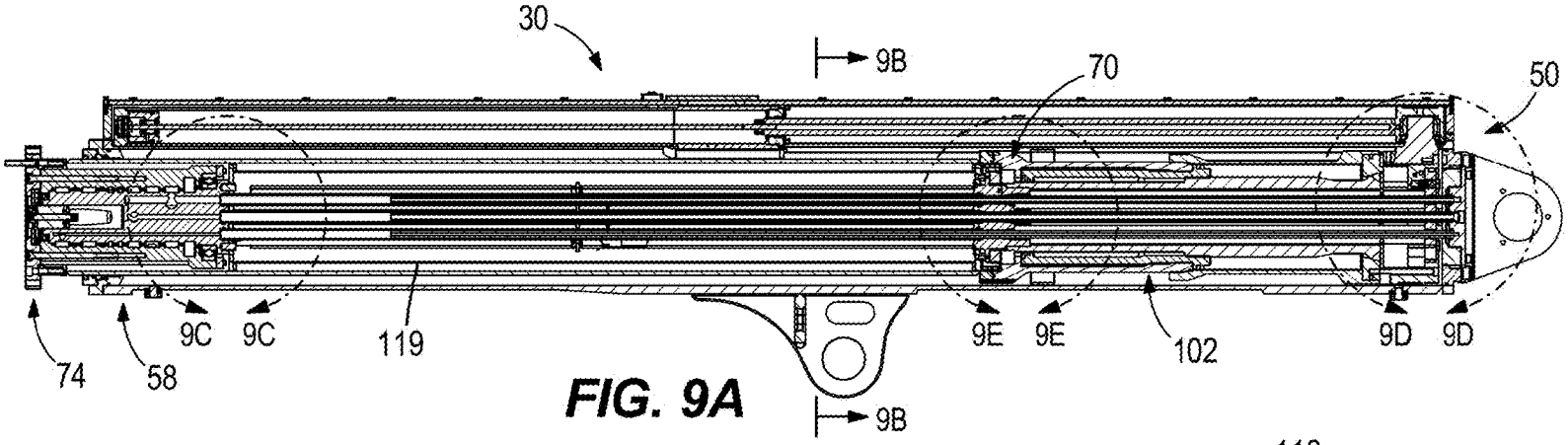
FIG. 9A is a section view of a boom according to another embodiment, viewed along a length of the boom.
Figure 9C:
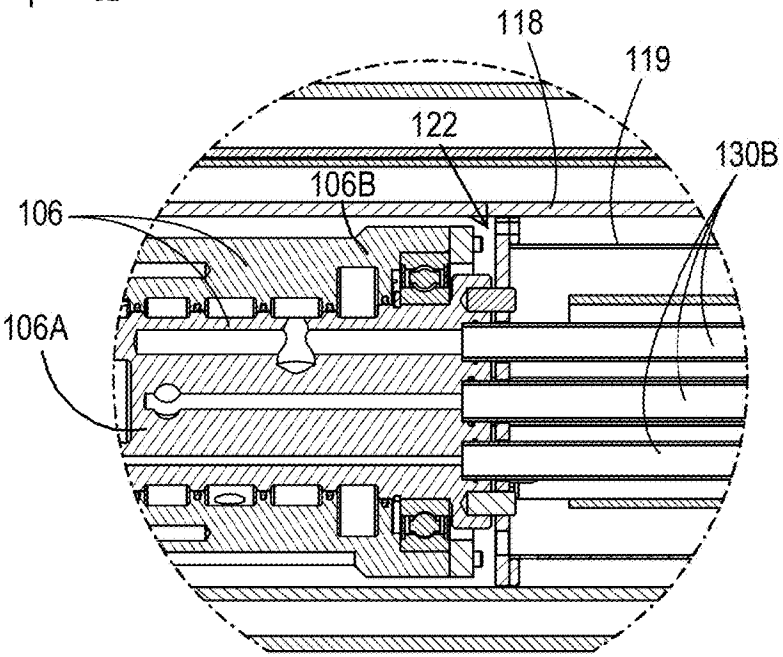
FIG. 9C is a detail view of the section view of FIG. 9A near a second end of the boom.
Figure 9B:
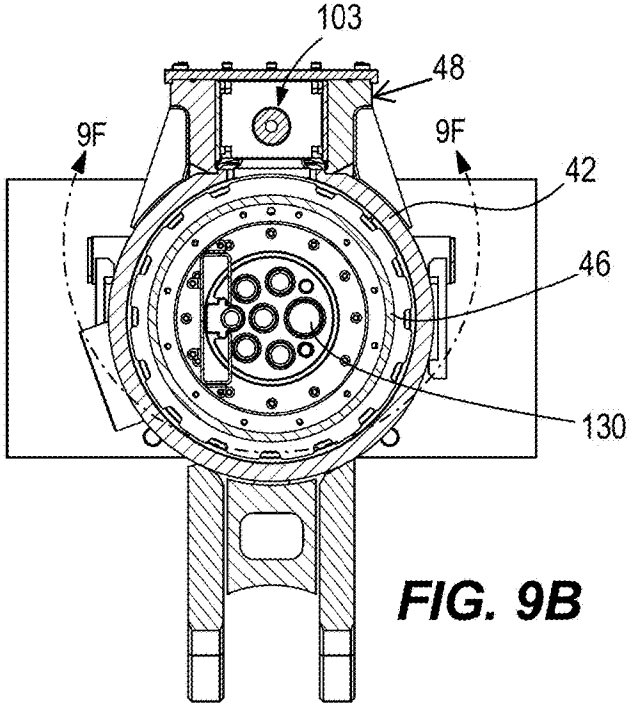
FIG. 9B is a section view of the boom of FIG. 9A, viewed along section 9B-9B.
Figure 9E:
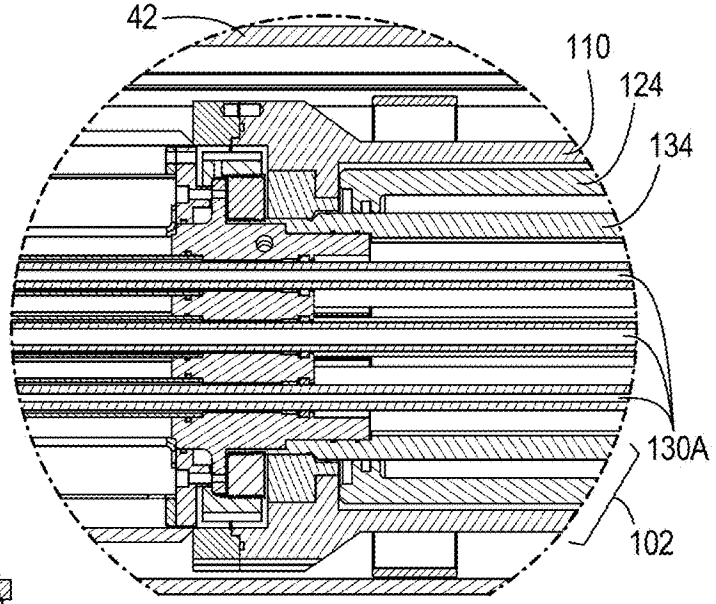
FIG. 9E is a detail view of the section view of FIG. 8A near a proximal end of the shaft.
Figure 9F:
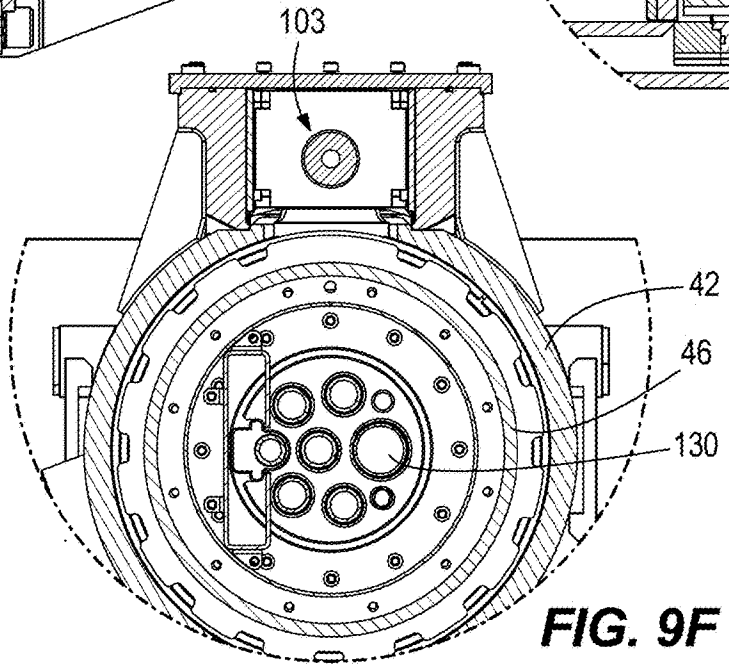
FIG. 9F is a detail view of the section view of FIG. 9B.
Figure 9D:
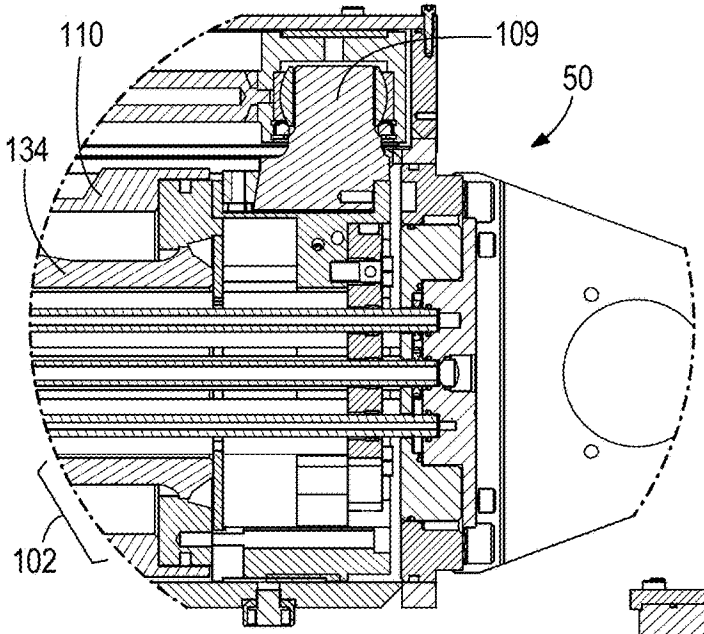
FIG. 9D is a detail view of the section view of FIG. 9A near an end of the shaft support and a first end of the boom.

As shown in FIGS. 5 and 6, the boom 30 includes an intermediate rotary actuator or shaft support 102 and a rotary flow distributor 106 (FIG. 8C). In the illustrated embodiment, the shaft support 102 is positioned within the housing 42. The shaft support 102 includes a body and a bearing 114 engaging an inner surface of the housing 42. In the illustrated embodiment, the boom 30 also includes a second bearing 116, which may be a non-contact bearing that prevents metal-on-metal contact in the event the boom deflects beyond a predetermined amount. In other embodiments, the second bearing may be omitted. The shaft support 102 includes an outer portion 110 and an inner portion 134 (FIG. 6). The outer portion 110 engages the housing 42, while the inner portion 134 engages the shaft 46. The shaft 46 supports therein trombone tubes 130, which provide passages that communicate between the ends of the boom 30 (for example, between the flow distributor 82 and the carrier 54). For example, these passages may carry fluids (e.g., hydraulic fluid), or wired connections. In some embodiments (e.g., FIG. 8C), a torque tube 119 may be positioned between the trombone tubes 130 and the shaft 46, to resist torsional stress from the shaft 46 to inhibit the torque from breaking or overly stressing the trombone tubes 130.

Figure 7:
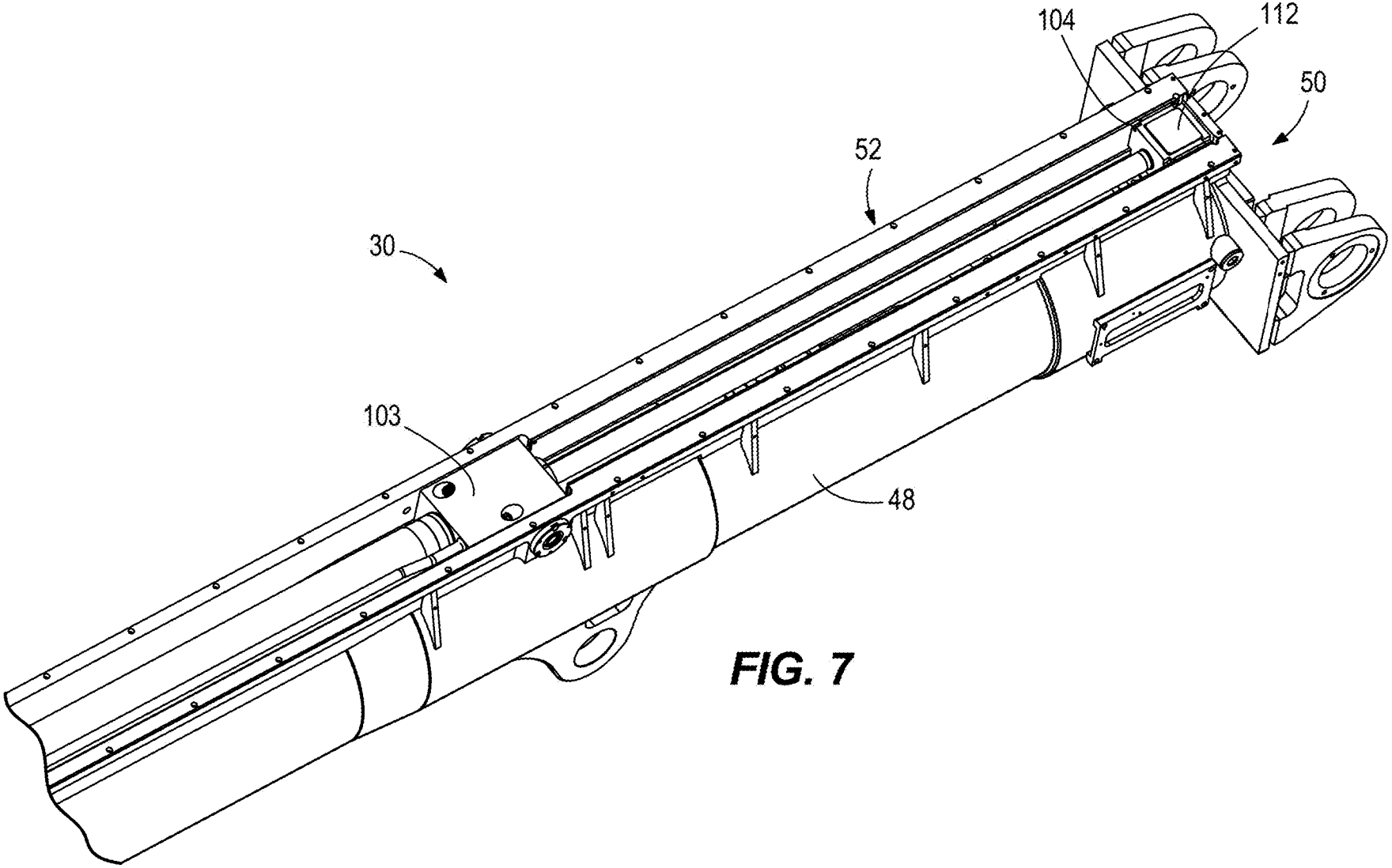
FIG. 7 is a perspective view of the boom of FIG. 5 with a cover removed to show within the rectangular portion of the housing.

As shown in FIGS. 6 and 7, the shaft support 102 includes a guide member (e.g., a guide pin 109) that extends radially away from the shaft support 102. As shown in the section view of FIG. 6, the overall profile of the housing 42 is key-shaped to facilitate proper orientation of the shaft support 102 relative to the housing 42, and limit the rotational movement of the shaft support 102 relative to the housing 42. Stated another way, the housing 42 includes a portion 48 having a circular profile, and a portion 52 that is positioned radially outward of the portion 48. The radially outward portion 52 may have a rectangular profile. In the illustrated embodiment, the shaft support 102 includes a portion having a circular profile positioned within the portion 48 of the housing 42 having a circular profile and locates the shaft 46 within the housing 42. The guide pin 109, on the other hand, is connected to a spherical bearing 115 positioned within the portion 52 of the housing 42 having a rectangular profile. A hydraulic cylinder 103 (is positioned adjacent the portion 52 and includes a rod end 104 coupled to the guide member 109 (e.g., by a yoke 112). Actuation of the hydraulic cylinder 103 moves the guide pin 109 along at least a portion of the housing 42 in a direction parallel to the axis 60. Since the guide pin 109 is connected to the shaft support 102, actuation of the hydraulic cylinder 103 moves the shaft support 102 axially within the housing 42. Further, the guide pin's 109 engagement with the spherical bearing 115 positioned within the rectangular portion 58 of the housing 42 prevents rotation of the support shaft 102 within the housing 42.

As shown in FIGS. 8A to 8F, in some embodiments, the trombone tubes 130 do not rotate relative to the housing 42, and the tubes 130 are positioned within a torque member (e.g., torque tube 119). The torque tube 119 is connected to the outer portion of the shaft support 110 and to an inner portion of the shaft 46. In some embodiments, the torque tube 119 may be formed as multiple portions. In the illustrated embodiment, the flow distributor 106 (FIG. 8C) is positioned proximate a distal end 74 of the shaft 46 and includes an inner portion 106A and an outer portion 106B that rotate relative to one another. During operation, the outer portion 106A of the flow distributor 106, an outer portion 118 (FIG. 8C) of the shaft 46, and the inner portion 134 (FIG. 8D) of the shaft support 102 rotate. An inner portion 122 (FIG. 8C) of the shaft 46 (including the torque tube 119 and the trombone tubes 130), the outer portion 110 of the shaft support 102, and the inner portion 106A of the flow distributor 106 do not rotate. The torque tube 119 inhibits and/or limits the stresses exerted on the trombone tubes 130, minimizes flexing of the trombone tubes, avoids damage to the tubes. Also, the torque tube 119 may improve accuracy of a sensed boom position in cases in which the movement of the shaft 46 relative to the flow distributor housing is used to monitor the boom position angle (i.e., a sensed position of the flow distributor shaft may more closely reflect the actual angle of the boom). Such flexing may be present in other booms in which, for example, interaction between a shaft support and trombone tubes results in the trombone tubes rotating with an inner portion of the shaft support, causing a male portion 130A or female portion 130B of the trombone tubes 130 to flex significantly.

In the illustrated embodiment of FIGS. 8A to 8F, the shaft support 102 is positioned adjacent the proximal end 70 of the shaft 46 and the flow distributor 106 is positioned adjacent the distal end 74 of the shaft 46. It is understood that this embodiment is one example, and other embodiments may incorporate a different configuration. Also, it is understood that, in other embodiments, the shaft support or the flow distributor may be configured in a reverse manner with respect to connection to the non-rotating first end 50 of the boom 30.

In other embodiments, as shown for example in FIGS. 9A to 9F, the inner portion 134 of the shaft support 102 may be coupled to the hydraulic cylinder 103, which causes the axial movement of the shaft 46 and shaft support 102. The outer portion 110 may be coupled to the shaft 46. As a result, the outer portion of the flow distributor 106, the shaft 46, and the outer portion 110 of the shaft support 102 are rotatable in the illustrated embodiment. The inner portion of the rotary flow distributor 106, the inner portion 134 of the shaft support 102 (including the torque tube 119 and female portions 130B of the trombone tubes 130), and the guide pin 119 are not rotatable. One advantage is that the torque tube 119 can be coupled directly to the inner portion 134 of the shaft support 102 and avoids providing a portion of the torque tube 119 passing through the shaft support 102.

Cables or wires may carry control power and communications signals between the fixed (i.e., the first end 50) and the extending portions (i.e., the distal end 74) of the boom 30. In some cases, the cables or wires remain the same length while the boom 30 axially extends and retracts, but there may be limited space within the boom 30 to house extra length of cable or wire when the boom 30 is in a retracted state.

Figure 10:
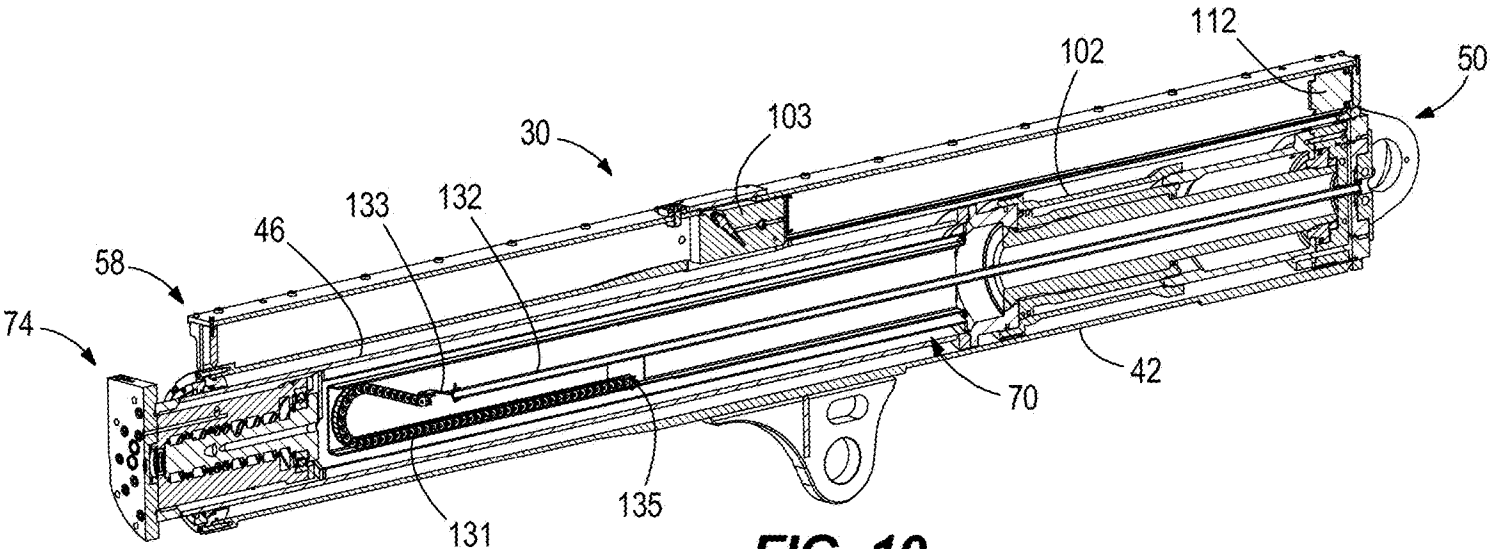
FIG. 10 is a section view of a boom in a retracted position, illustrating a cable guide chain.
Figure 11:
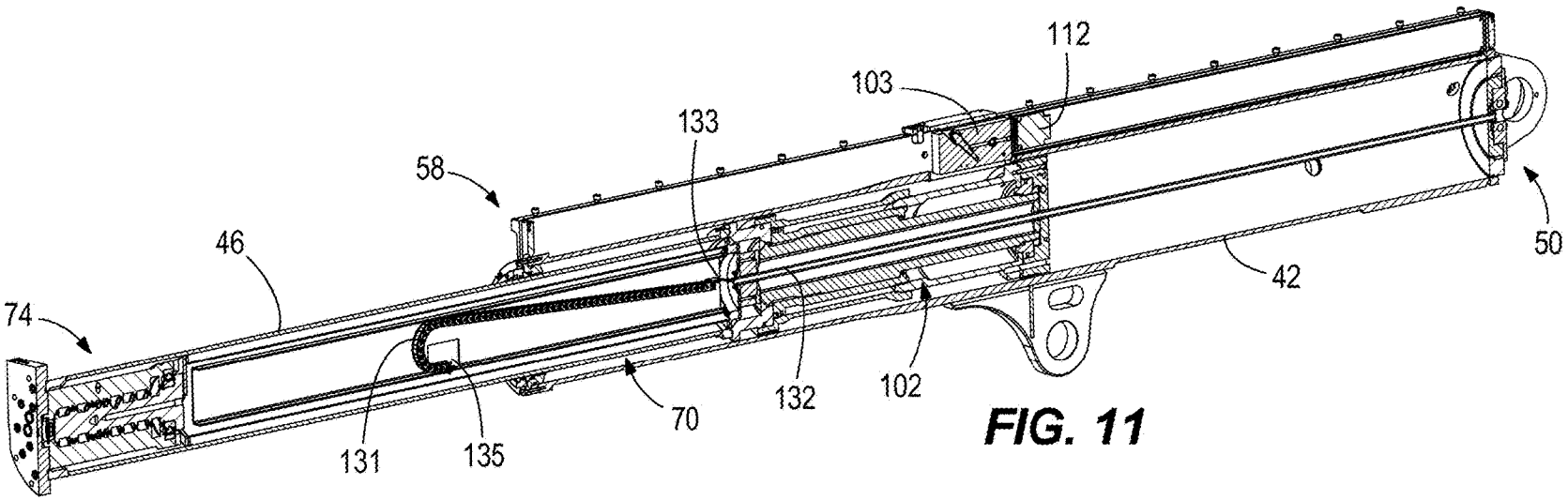
FIG. 11 is a section view of the boom of FIG. 10 in an extended position.

As shown in FIGS. 10 to 13, the boom 30 may include a cable guide chain 131. FIG. 10 illustrates the shaft 46 in a retracted position relative to the first end 50, while FIG. 11 illustrates the shaft 46 in an extended position. The cable guide chain 131 may include a plurality of links coupled to the cable, and the links of the cable guide chain 131 can bend/flex in a controlled manner within the boom 30. One end of the cable guide chain 131 is connected to a tube 132 (i.e., one of the trombone tubes 130) that carries the cables or wires from a connection point 133 to the inside of the shaft 46. Another end of the cable guide chain 131 is connected at a connection point 135 to a portion of the boom 30 that extends, for example, an inside wall of the shaft 46. This allows the cables or wires to be guided by the cable guide chain 131 in a controlled manner and extend and retract within the shaft 46 free from damage. The cable guide chain 131 manages the cables or wires to minimize the risk of tangling, twisting, shearing, or other damage.

Figure 12:
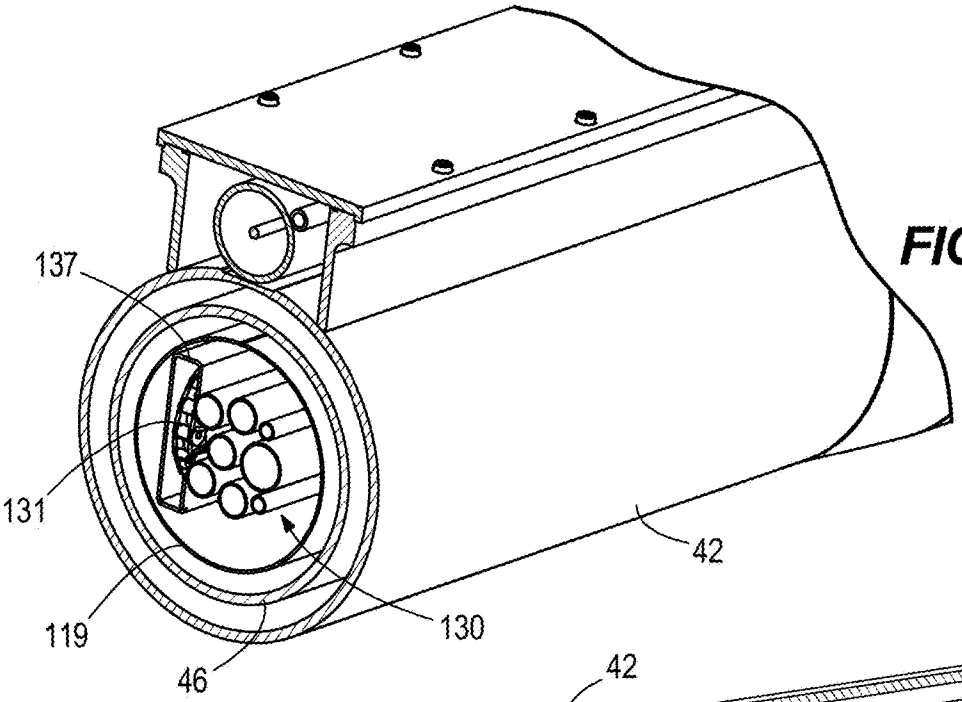
FIG. 12 is a cross-section view of the boom of FIG. 10 illustrating a chain guide bracket.
Figure 13:
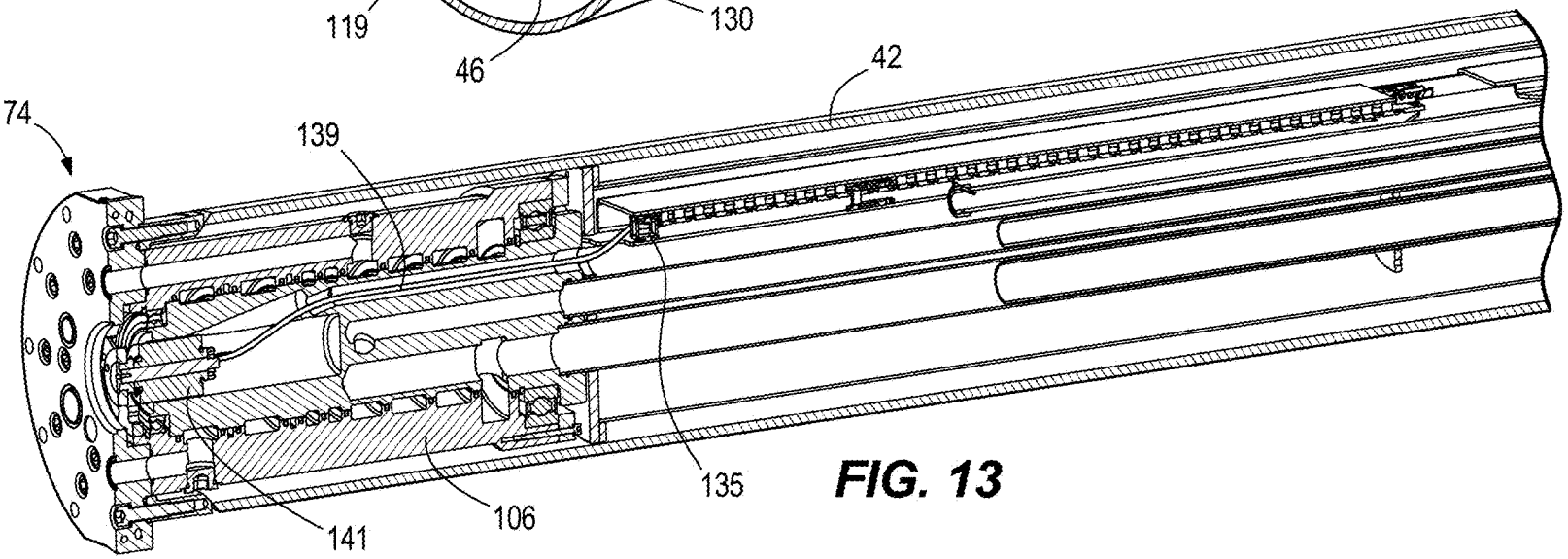
FIG. 13 is a section view of the boom of FIG. 10 illustrating a cable connection to a slip ring.
Figure 14:
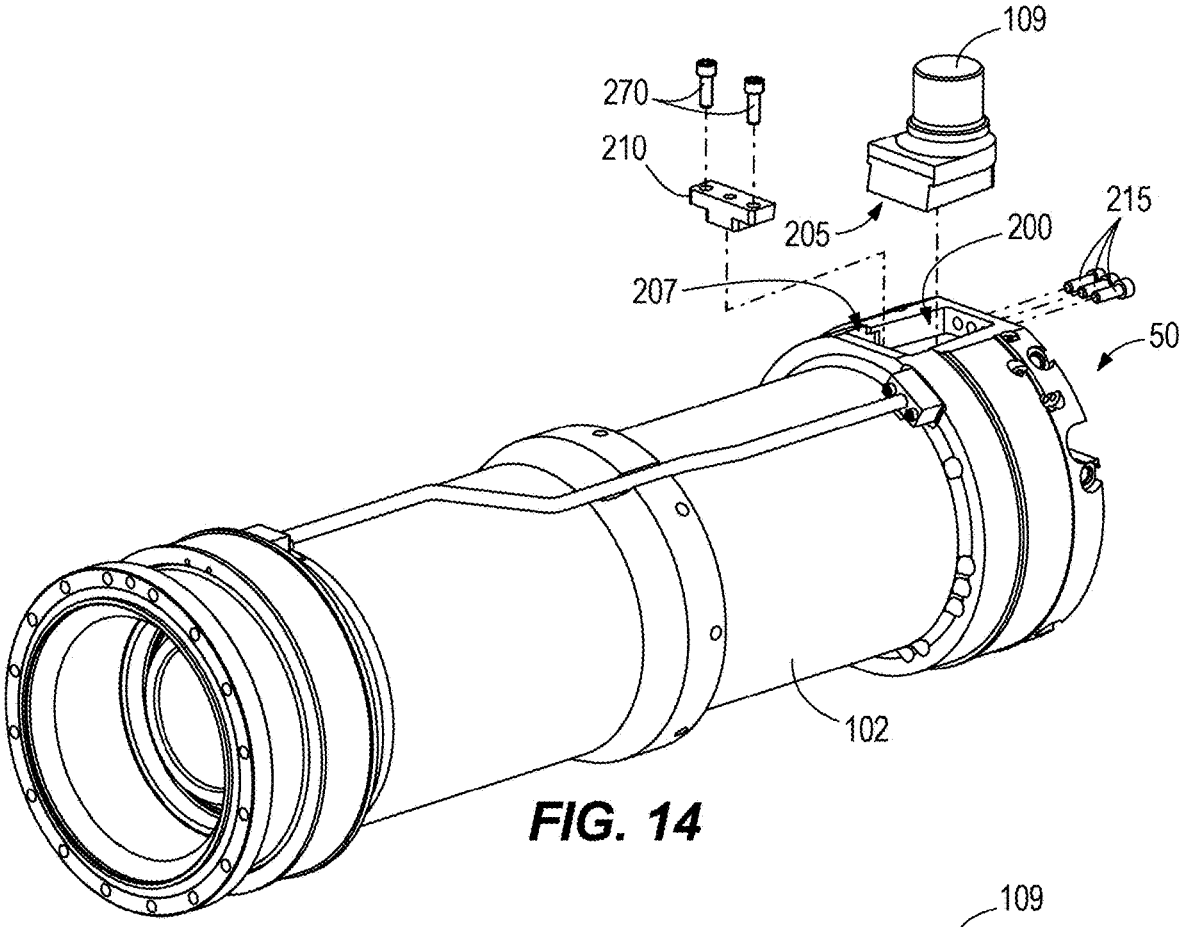
FIG. 14 is an assembly view of a shaft support.
Figure 15:
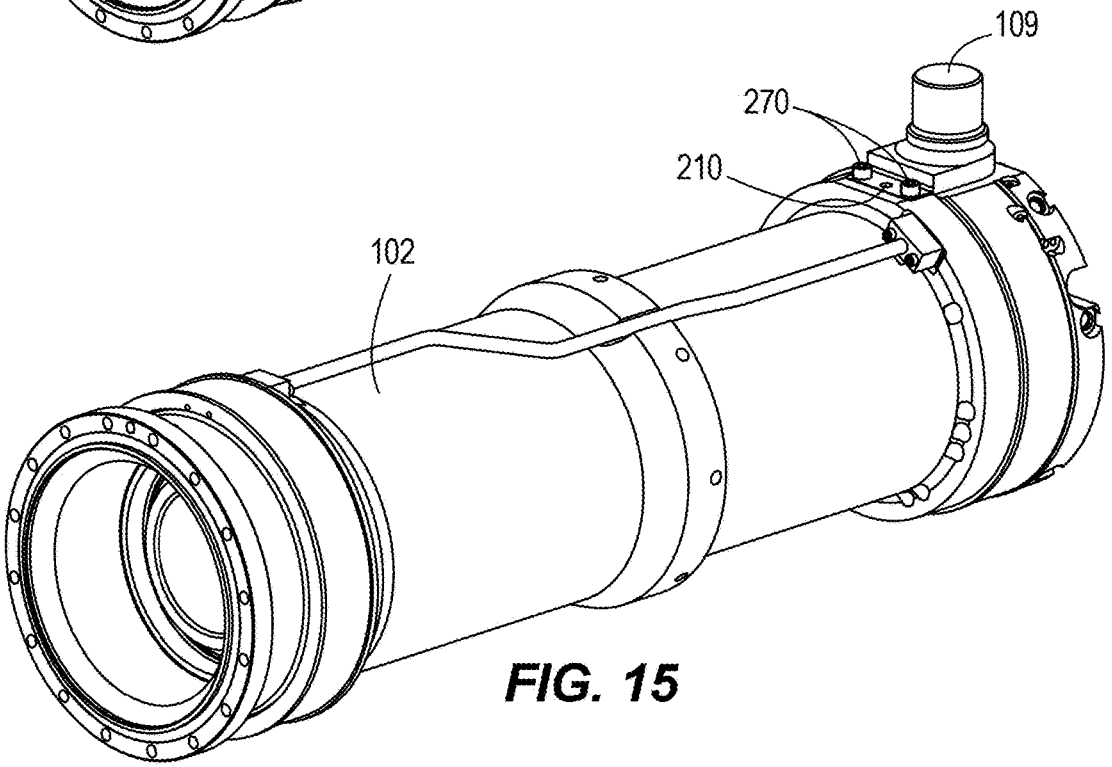
FIG. 15 is a perspective view of the shaft support of FIG. 14.
Figure 16:
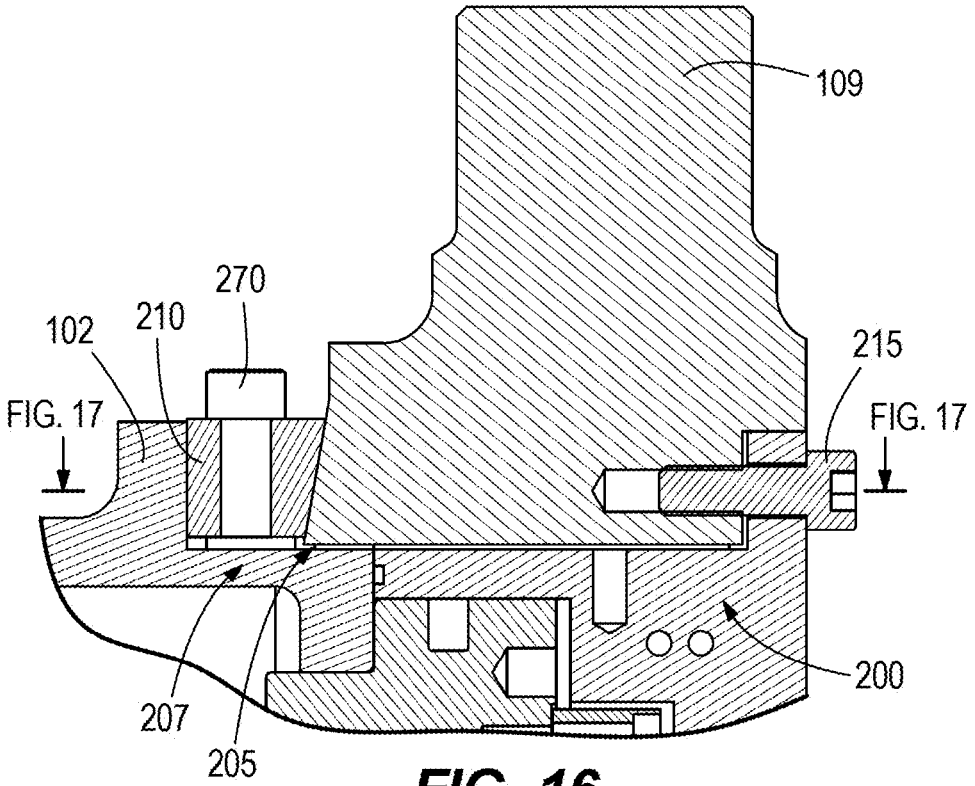
FIG. 16 is a side-section view of a portion of the shaft support of FIG. 14.
Figure 17:
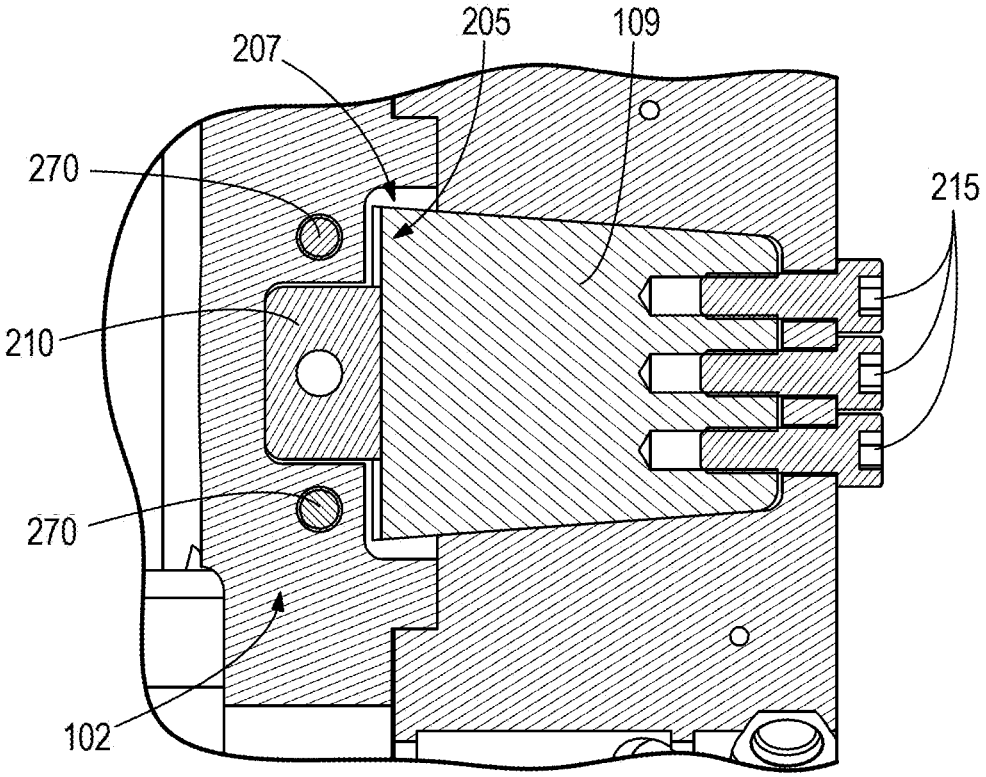
FIG. 17 is a top-section view of a portion of the shaft support of FIG. 14.

The cable guide chain 131 may be supported within a guide bracket 137 (FIG. 12). In the illustrated embodiment, the guide bracket 137 extends alongside the trombone tubes 130. The guide bracket 137 retains the cable guide chain 131 to control the position of the cable guide chain 131 as the shaft 46 extends and retracts and minimizes the risk that the cable guide chain 131 will twist or catch on another structure. FIG. 13 illustrates a portion of a cable 139 extending from the connection point 135. The cable 139 is guided from the shaft 46 into a slip ring 141 within the flow distributor 106 to be connected to equipment at the distal end 74 of the shaft 46.

FIGS. 14 to 17 illustrate a device and method for coupling the guide member 109 to the shaft support 102. In some cases, the guide member 109 transmits large forces between the housing 42 and the shaft support 102. The guide member 109 may be coupled to the shaft support 102 with an interference fit to prevent excessive movement and wear between the interface of the guide member 109 and shaft support 102, while also facilitating removal/replacement of the guide member 109 as needed without requiring complicated disassembly (e.g., removing the shaft support 102).

In the illustrated embodiment, the guide member 119 is coupled to the shaft support 102 by a wedge-shaped protrusion 205 secured within a wedge-shaped pocket 207. In the illustrated embodiment, the wedge-shaped protrusion is positioned on the guide member 109 and the wedge-shaped pocket 207 is positioned on the shaft support 102; it is understood that, in other embodiments, the coupling may be accomplished in a different manner.

The wedge-shaped protrusion 205 is positioned within the wedge-shaped pocket 207 and retained therein by drive bolts 215 that engage the shaft support 102 from the first end 50. The drive bolts 215 draw the guide member 109 into the wedge-shaped pocket 207 to provide an interference fit. The guide member 109 is further fixed into the wedge-shaped pocket 207 via a retaining block 210 that, when tightened against the shaft support 102 with retaining block bolts 270, interferes with the wedge-shaped protrusion 205 to hold the guide member 109 against the shaft support 102. To remove the guide member 109, the retaining block bolts 270, the retaining block 210, and drive bolts 215 are removed, and the guide member 109 can be tapped out of the wedge-shaped pocket 207 to disengage the interference fit between the protrusion 205 and the wedge-shaped pocket 207. Thus, the guide member 109 can be easily removed from the wedge-shaped pocket 207, without requiring a time-consuming and expensive process for accessing and servicing the guide pin.

Figure 18:
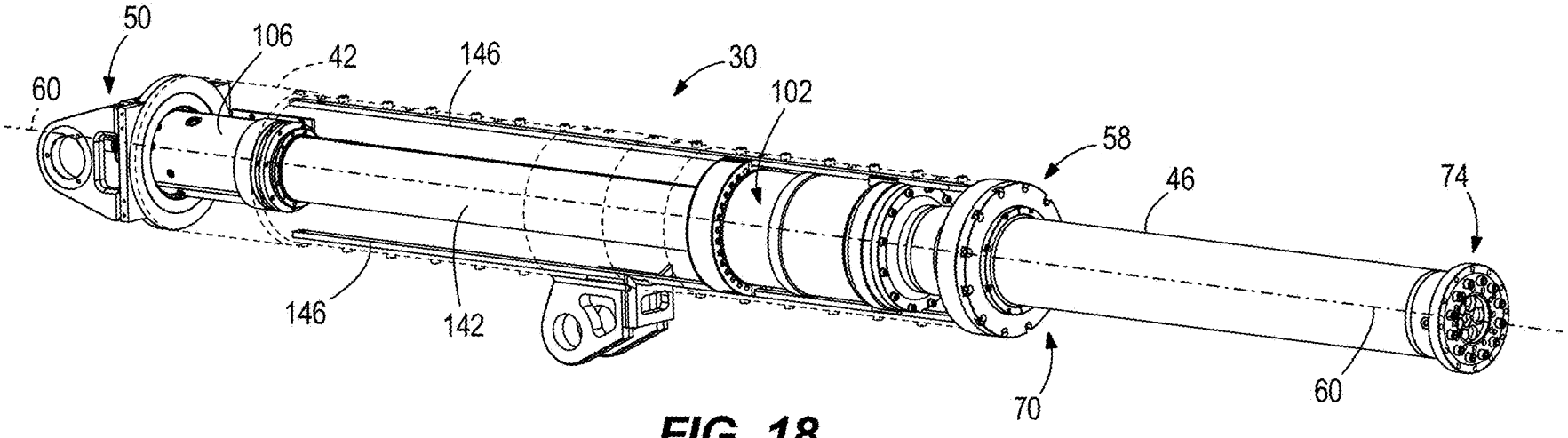
FIG. 18 is a perspective view a boom in an extended position with the housing shown in broken lines.
Figure 19:
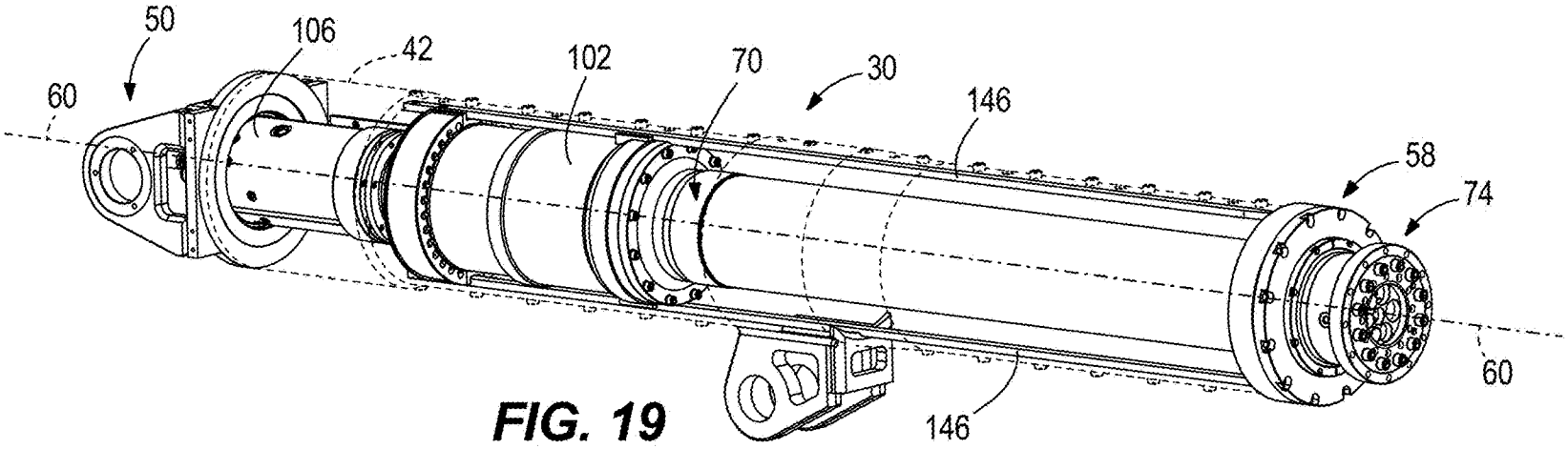
FIG. 19 a perspective view of the boom of FIG. 18 in a retracted position.
Figure 20:
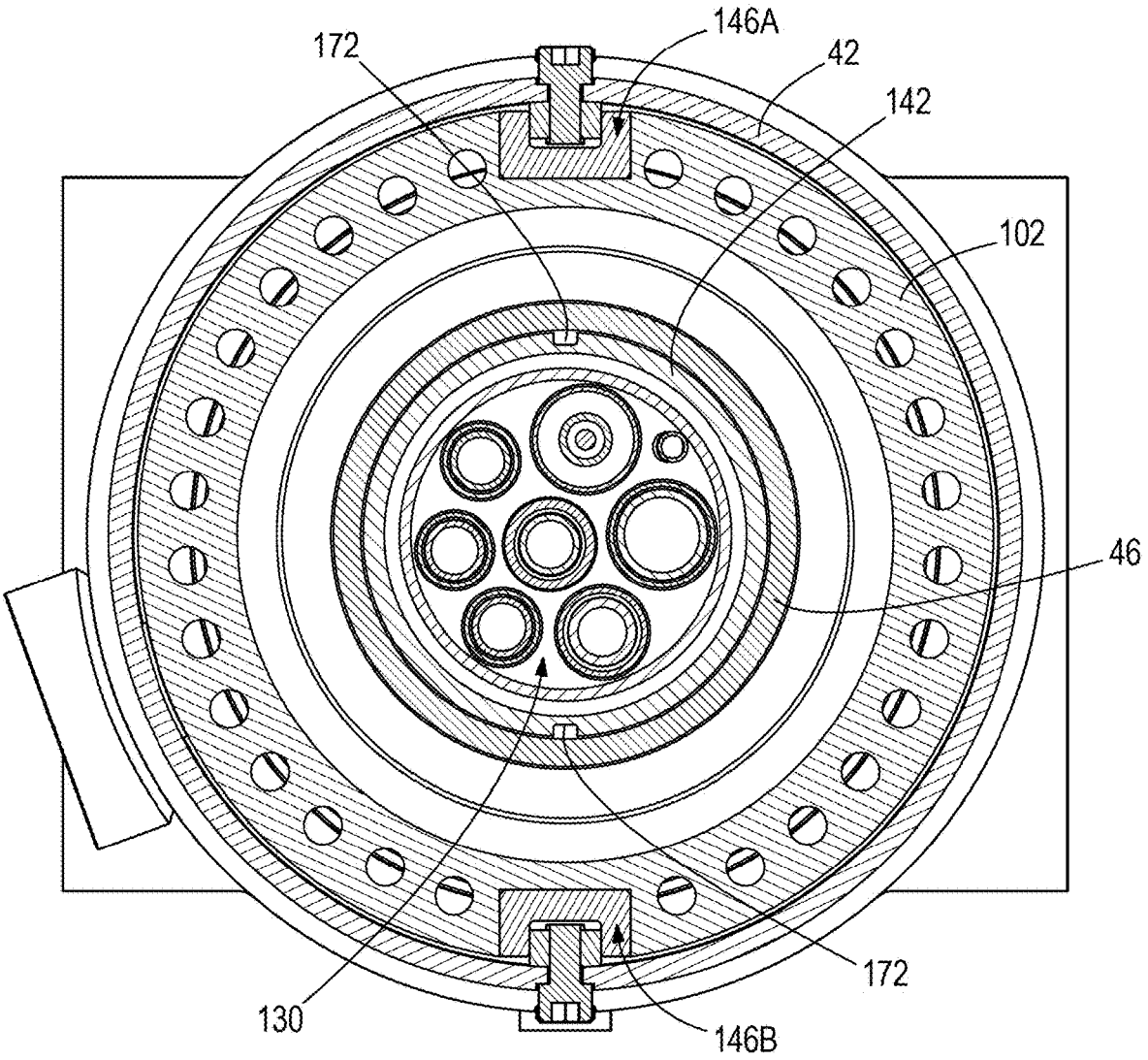
FIG. 20 is a section view of a boom.

Referring now to FIGS. 18 and 19, the shaft support 102 may be provided with a hydraulic cylinder along the central axis of the boom 30 that operates to extend the shaft 46 from an extension cylinder 142. In FIGS. 18 and 19, the housing 42 is shown in broken lines to better illustrate these features. The extension cylinder 142 passes though the shaft support 102. The flow distributor 106 is positioned at the first end 50, and the flow distributor 106 is connected to the extension cylinder 142. The shaft support 102 is slidably connected to the extension cylinder 142 and is connected to the shaft 46. As a result, the extension cylinder 142 operates to extend or retract the shaft support 102 and shaft 46 (FIG. 19) and extend the shaft support 102 and shaft 46 (FIG. 18) relative to the housing 42. The flow distributor 106 and the shaft support 102 are rotationally fixed with respect to the housing 42, but the extension cylinder 142 and the shaft 46 are rotatable along the housing axis 60. FIG. 20 illustrates cylinder guide grooves 172, which are the rotational connection between the extension cylinder 142 and the shaft 46. The cylinder guide grooves 172 are provided on opposite exterior walls of the extension cylinder 142 (i.e., the cylinder guide grooves 172 are diametrically opposed) to interface with a protrusion (not shown) on an interior wall of the shaft 46 such that the shaft 46 is axially slidable relative to the extension cylinder 142, but is not rotatable relative to the extension cylinder 142. It is understood that, in other embodiments, the cylinder guide grooves and the corresponding protrusions may be configured in another manner.

Figure 21A:
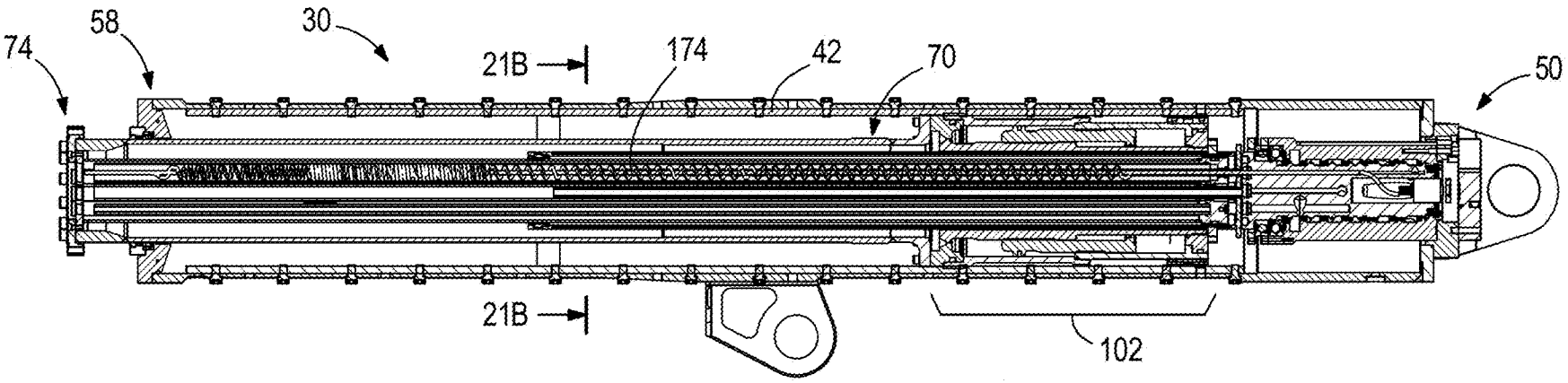
FIG. 21A is a section view of a boom in a retracted position.
Figure 21B:
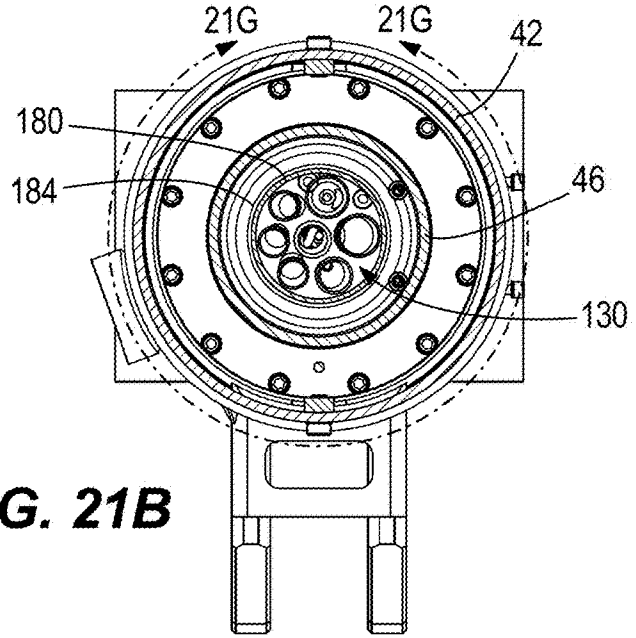
FIG. 21B is a section view of the boom of FIG. 21A, viewed along section 21B-21B.
Figure 21C:
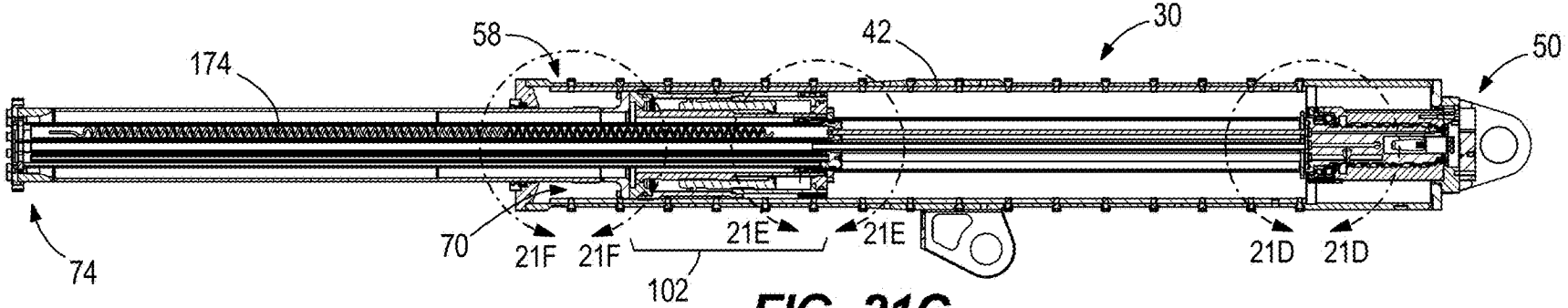
FIG. 21C is a section view of the boom of FIG. 21A in an extended position.
Figure 21E:
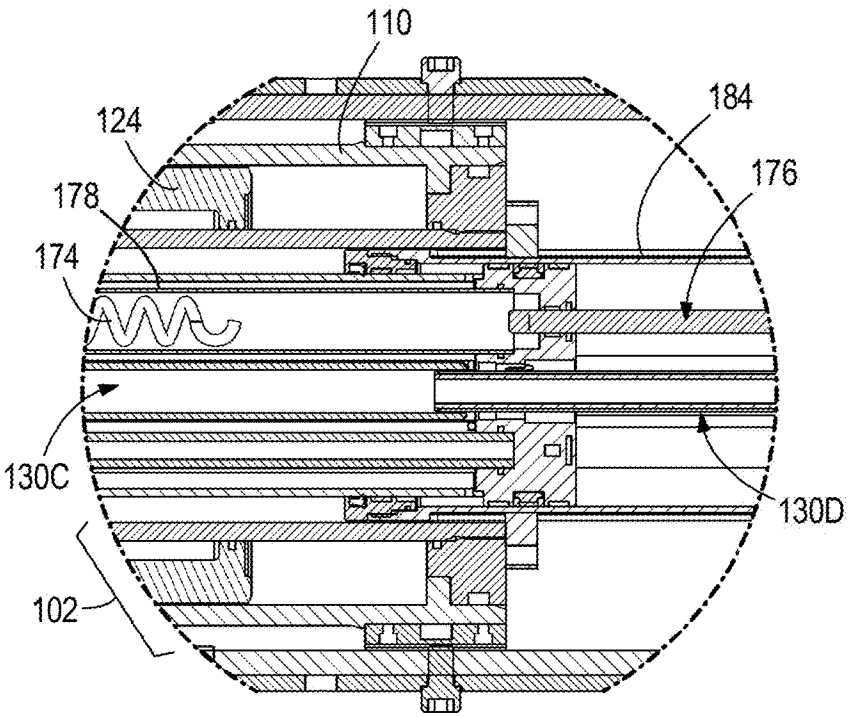
FIG. 21E is a detail view of the section view of FIG. 21A near an end of the shaft support.
Figure 21D:
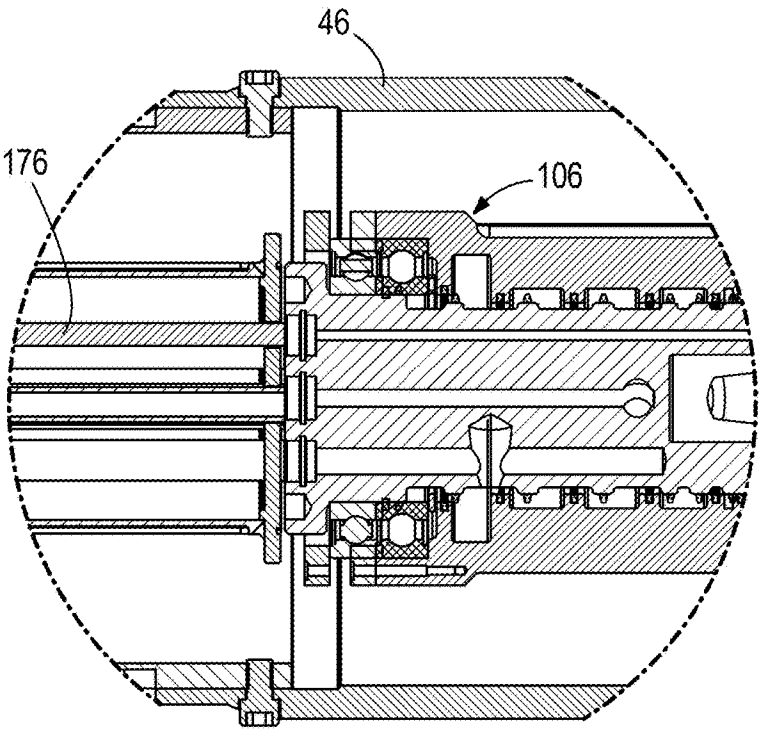
FIG. 21D is a detail view of the section view of FIG. 21A at a first end of the boom.
Figure 21F:
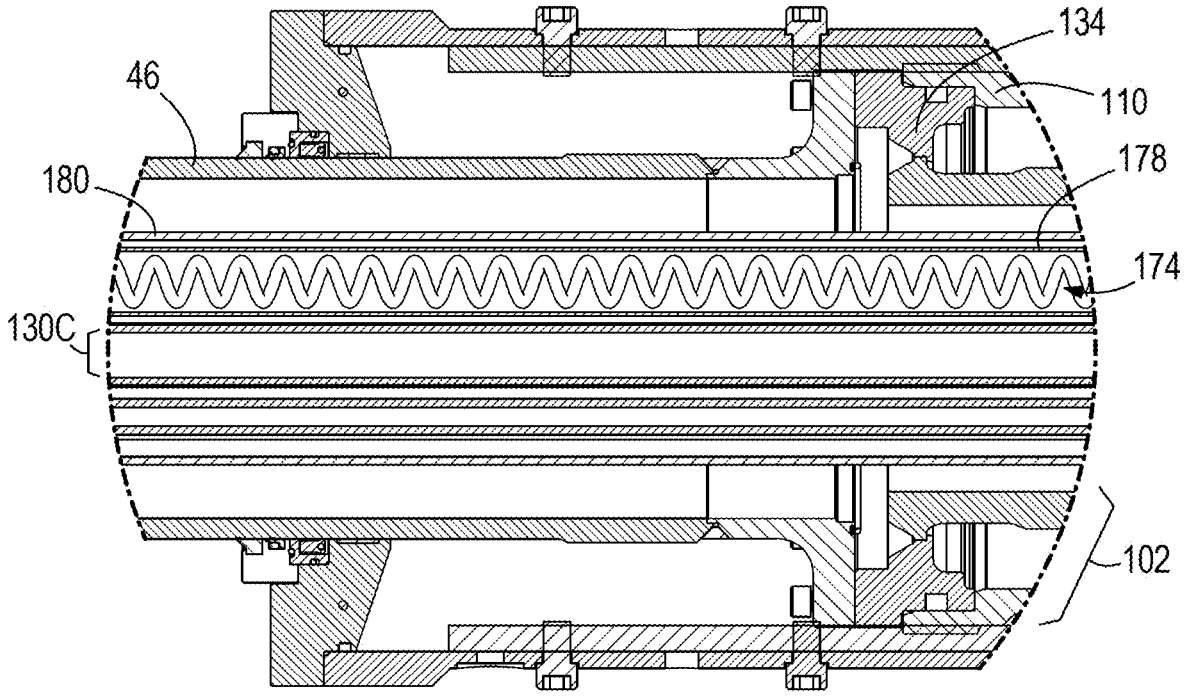
FIG. 21F is a detail view of the section view of FIG. 21A near a second end of the boom.
Figure 21G:
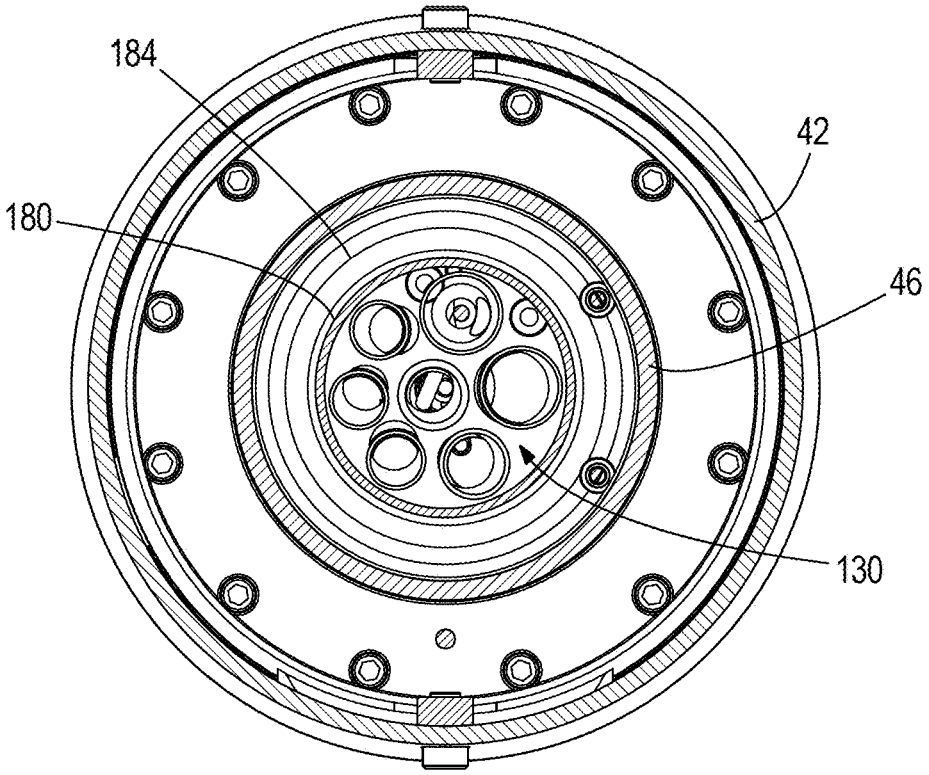
FIG. 21G is a detail view of the section view of FIG. 21B.

As seen in FIGS. 20 to 21G, trombone tubes 130 are provided within the shaft 46 and extension cylinder 142. In the illustrated embodiment, male portions 130D (FIG. 21E) of the trombone tubes are positioned in the extension cylinder 142, and one end of each male portion 130D is received in an associated female portion 130C positioned within the shaft 46. A person of skill in the art would understand that this could be reversed, i.e., male trombone tubes 130D could be positioned within the shaft 46 for insertion into female trombone tubes 130C in the extension cylinder 142. These trombone tubes 130C and 130D provide passages from the first end 50 to the distal end 74 to carry fluids, electrical connections, or the like along the length of the boom 30. The cylinder guide grooves 172 secure the extension cylinder 142 against rotation relative to the shaft 46, so that when these components are rotated with the male and female trombone tubes 130C and 130D therein, the trombone tubes 130C and 130D are not subject to twisting or torsional forces.

Referring now to FIGS. 18 to 21G, guide members are provided on opposite interior walls of the housing 42. In the illustrated embodiment, the guide members include guide tracks 146A, 146B that are diametrically opposed and positioned on the shaft support 102, and guide protrusions positioned on an interior surface of the housing 42 engage the tracks 146A, 146B. These guide members secure the shaft support 102 against rotation relative to the housing 42, but allow the shaft support 102 to be slidable relative to the housing 42. It is understood that, in other embodiments, the guide tracks and the corresponding protrusions may be configured in another manner.

Figure 22:
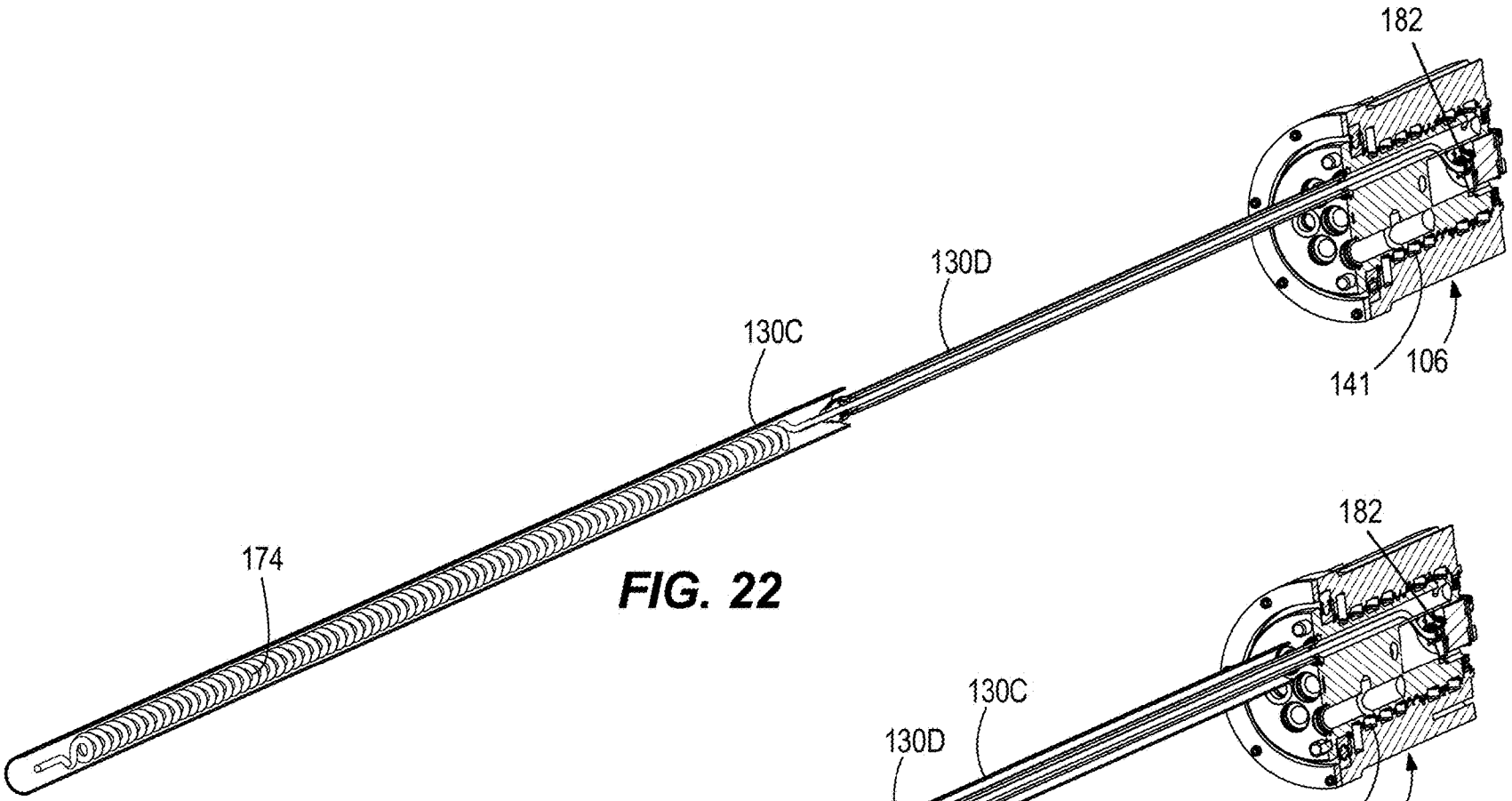
FIG. 22 is a section view of a portion a boom in an extended position.
Figure 23:
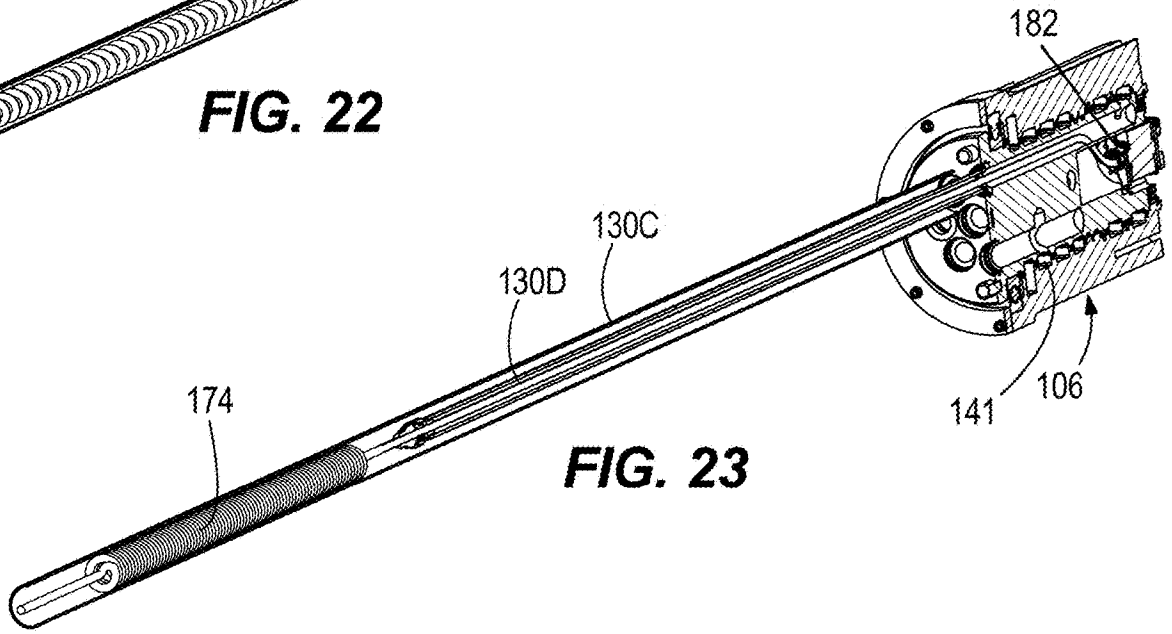
FIG. 23 is a section view of the boom of FIG. 22 in a retracted position.

As best illustrated in FIGS. 21A-G, 22, and 23, trombone tubes 130 provide a channel in order to transfer an electronic control signal and control power via a cable 174 (e.g., a spirally coiled cable) from the first end 50 to the distal end 74. A cable inner tube 176 houses a straight portion of the cable 174 of a fixed length, and a cable outer tube 178 houses a spirally wound portion of the cable 174 that can stretch by nature of the spiral winding (e.g., by reducing diameter and extending pitch). The cable 174 is connected to a slip ring 182 (FIG. 22) within the flow distributor 106 to provide an electrical connection for both the rotating and non-rotating parts of the boom 30. FIGS. 21A and 23 illustrate the cable 174 in a retracted position (e.g., while the distal end of the shaft 46 is retracted with respect to the second end 58 of the housing 42). FIGS. 21C and 22 illustrate the cable 174 in an extended position (e.g., while the distal end of the shaft 46 is extended away from the second end 58 of the housing 42). FIGS. 21A and 21C differ from FIGS. 22 and 23 in that FIGS. 22 and 23 are illustrated with the shaft 46 removed to more easily show the cable 174 in the trombone tube 130.

Figure 24:
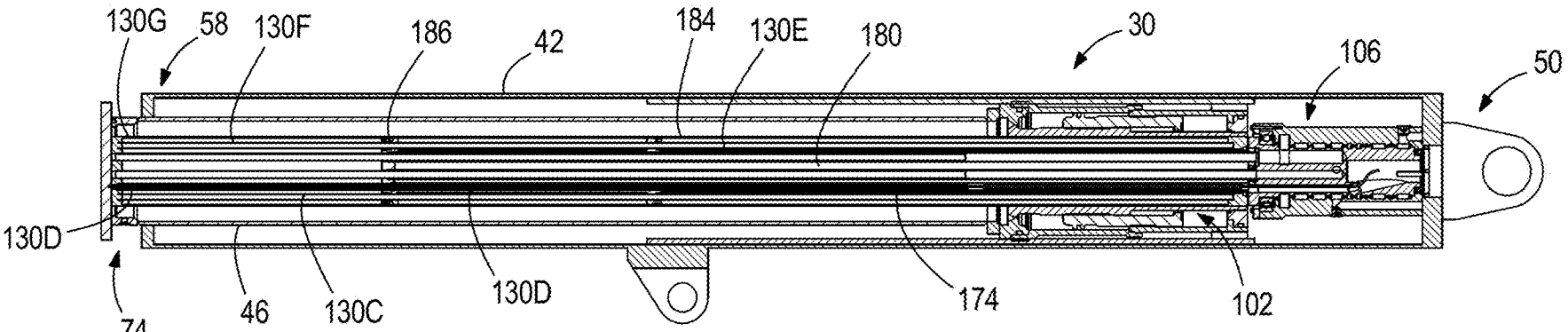
FIG. 24 is a section view of a boom in a retracted position.
Figure 25:
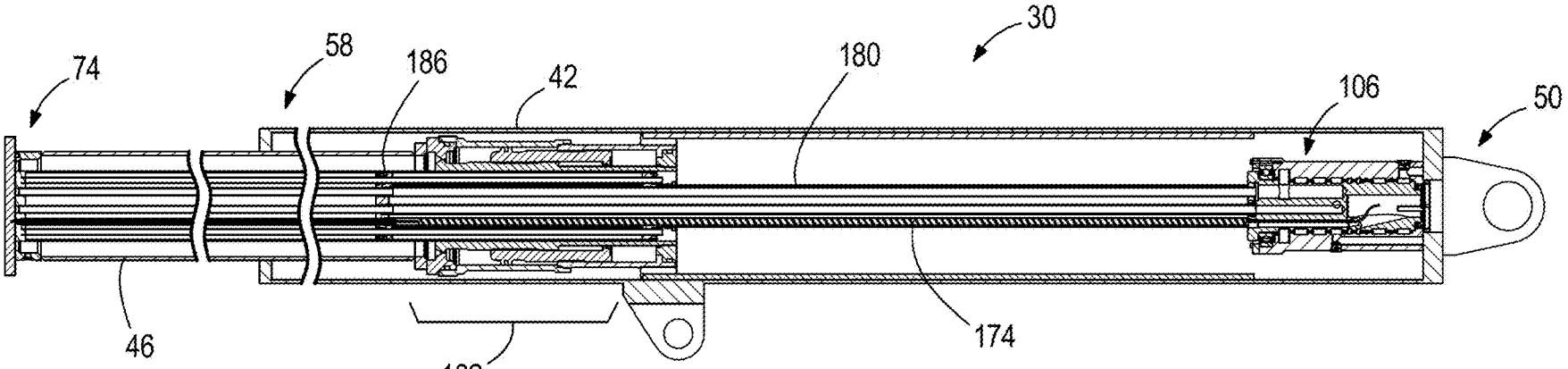
FIG. 25 is a section view of the boom of FIG. 24 in an extended position.

FIGS. 24 and 25 illustrate another embodiment of a boom 30 in retracted (FIG. 24) and extended (FIG. 25) positions. An orientation of the cylinder is reversed, and the boom 30 includes guide rods or guide tubes 150. For example, male and female trombone tubes 130E and 130F are inserted inside an extension cylinder outer portion 184, pass through an extension cylinder piston 186, and then pass into the extension cylinder inner portion 180. In this configuration, the extension cylinder outer portion 184 can be fixed to a rotary actuator (e.g., actuator 82—see FIG. 4) and the trombone tubes 130 provide fluid conduits from a control valve (not shown) that controls the rotation of the rotary actuator 82. In this embodiment, the outer portion of the shaft support 102 and the outer portion of the flow distributor 106 are rotatably fixed relative to the housing 42. Other interior components, such as the extension cylinder inner portion 180, extension cylinder piston 186, shaft 46, the inner portion of the shaft support 102, and the inner portion of the flow distributor 106 may be rotatable relative to the housing 42.

Figure 26:
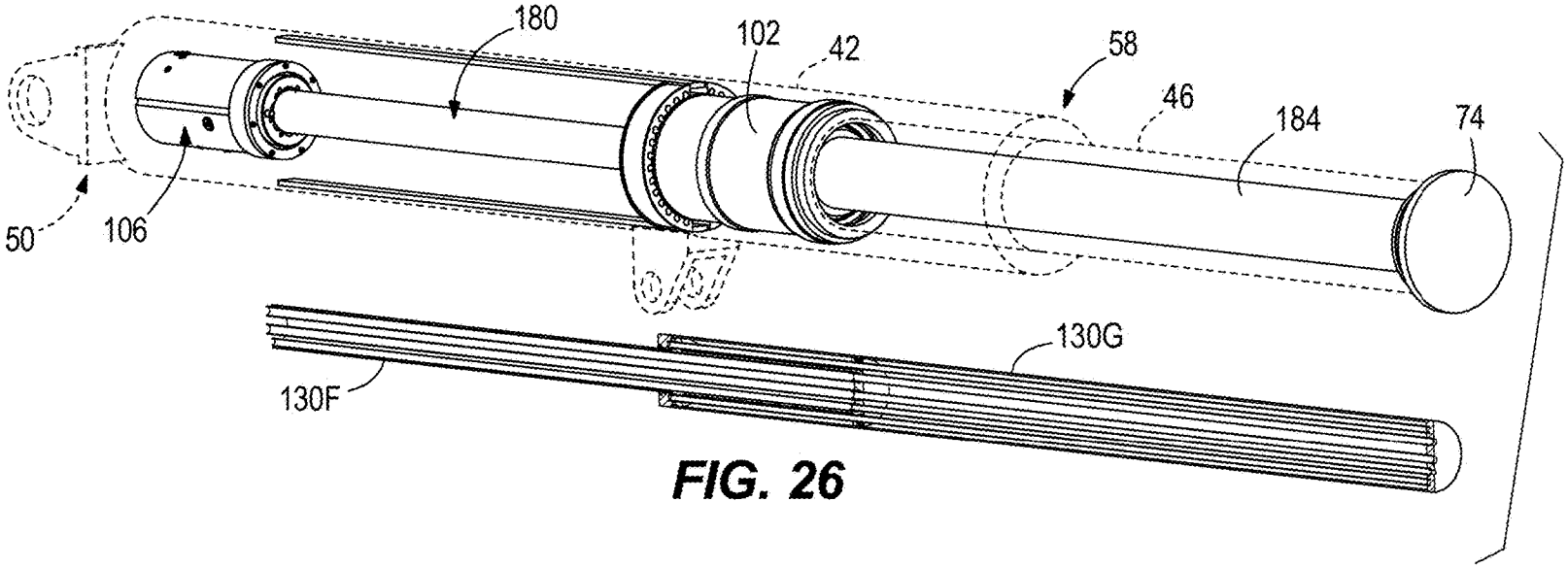
FIG. 26 is a perspective, section view of the boom of FIG. 24 in the extended position with the housing and shaft shown in broken lines and including an inset section view within the shaft.
Figure 27:
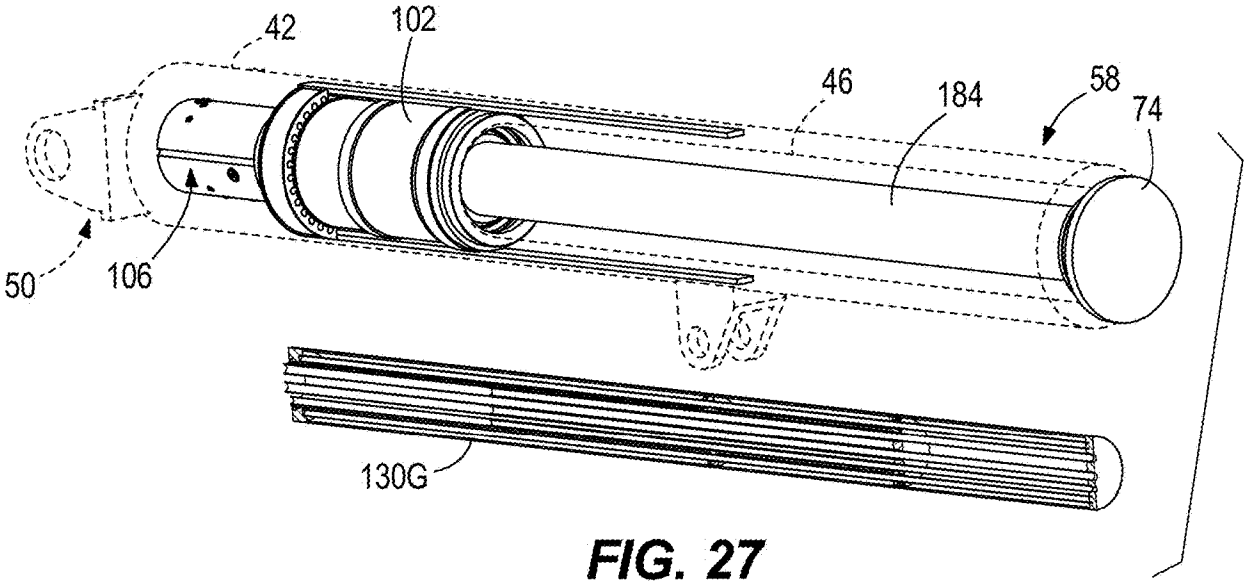
FIG. 27 is a perspective, section view of the boom of FIG. 24 in the retracted position with the housing and shaft shown in broken lines and including an inset, section view within the shaft.

FIGS. 26 and 27 illustrate the boom 30 of FIGS. 24 and 25 in extended (FIG. 26) and retracted (FIG. 27) positions with the extension cylinder outer portion 184 and the housing 42 shown in broken lines to better illustrate the extension cylinder 180 and the shaft 46. Trombone tubes or guide tubes 130F (male) and 130G (female) are shown inset to better illustrate these features within the extension cylinder 180 and the shaft 46.

Although various aspects have been described in detail with reference to certain preferred embodiments, variations and modifications exist within the scope and spirit of one or more independent aspects as described. Various features and advantages are set forth in the following claims.

What is claimed is:

1. A boom for supporting a drilling and bolting tool, the boom comprising:

a first portion including a first end, a second end, and a longitudinal axis extending between the first end and the second end, the first portion including a housing having a cylindrical portion with a substantially circular profile;

a second portion including an elongated shaft having a proximal end and a distal end, the proximal end supported by a shaft support for translational movement relative to the first portion in a direction parallel to the longitudinal axis, the distal end configured to support the drilling and bolting tool;

an actuator for moving the second portion relative to the first portion in a direction parallel to the longitudinal axis;

a guide track; and a guide member for engaging the guide track and inhibiting rotation of the shaft support about the longitudinal axis, the guide member positioned on one of the first portion and the second portion and extending in a radial direction with respect to the longitudinal axis, at least a portion of the guide member being positioned outside of the substantially circular profile of the cylindrical portion.

2. The boom of claim 1, wherein the guide member includes a spherical bearing for engaging the guide track.

3. The boom of claim 1, wherein the actuator includes a hydraulic cylinder, an end of the hydraulic cylinder coupled to the guide member, wherein actuation of the hydraulic cylinder is operable to cause translational movement of the second portion relative to the first portion in the direction parallel to the longitudinal axis.

4. The boom of claim 1, wherein the housing of the first portion includes a rectangular portion positioned radially outward of the cylindrical portion, wherein the elongated shaft is positioned within the cylindrical portion, and wherein the guide track and guide member are positioned within the rectangular portion.

5. The boom of claim 4, wherein the guide member includes a spherical bearing positioned within the rectangular portion and engaging the guide track.

6. The boom of claim 1, the boom further comprising:

a rotary flow distributor positioned within the first portion and in fluid communication with a fluid source; and a plurality of conduits extending between the rotary flow distributor and the distal end of the second portion, the plurality of conduits extending through the shaft support and the elongated shaft.

7. The boom of claim 6, wherein the plurality of conduits are configured to provide communication between a first end of the first portion and the drilling and bolting tool.

8. The boom of claim 1, wherein the guide member is secured to the shaft support by an interference fit.

9. The boom of claim 8, wherein the shaft support includes a slot having a wedge surface, wherein the guide member includes a wedge surface engaging the wedge surface of the slot in the interference fit, the guide member secured by at least one fastener passing through a portion of the shaft support.

10. The boom of claim 8, wherein the guide member is further retained within a slot of the shaft support by a retaining block positioned adjacent an end of the guide member.

11. A boom for supporting a drilling and bolting tool, the boom comprising:

a first portion including a first end, a second end, and a longitudinal axis extending between the first end and the second end;

a second portion including a proximal end and a distal end, the proximal end supported for translational movement relative to the first portion in a direction parallel to the longitudinal axis, the distal end configured to support the drilling and bolting tool;

a support portion supporting the second portion for movement relative to the first portion;

a plurality of passages extending at least between the distal end and the proximal end; and a torsion member including a tube extending between the proximal end and the distal end and transmitting torque between the proximal end and the distal end, the tube reducing a torque exerted on the plurality of passages, wherein the plurality of passages are positioned within the tube.

12. The boom of claim 11, the boom further comprising:

a rotary flow distributor positioned adjacent one of the proximal end and the distal end of the second portion, the rotary flow distributor including a rotatable portion and a non-rotatable portion, wherein the torsion member is secured to the non-rotatable portion.

13. The boom of claim 11, wherein the plurality of passages extend between the distal end and the first end of the first portion.

14. The boom of claim 11, the boom further comprising:

a rotary flow distributor positioned within the first portion and in fluid communication with a fluid source, a portion of the rotary flow distributor being rotatable with the second portion, wherein the plurality of passages extend between the rotary flow distributor and the distal end of the second portion, the plurality of passages extending through the second portion and the support portion.

15. The boom of claim 11, the boom further comprising:

a rotary flow distributor positioned within the second portion and in fluid communication with a fluid source, a portion of the rotary flow distributor being rotatable with the second portion, wherein the plurality of passages extend between the rotary flow distributor and the first end of the first portion, the plurality of passages extending through the second portion and the support portion.

16. The boom of claim 11, the boom further comprising:

a pair of guide tracks extending along an inside of the first portion and engaging an outside of the support portion to inhibit rotation of the support portion relative to the first portion.

17. The boom of claim 16, wherein the pair of guide tracks are positioned on opposite sides of the support portion.

18. The boom of claim 11, the boom further comprising:

a flow distributor secured to the distal end of the second portion, the flow distributor configured to support the drilling and bolting tool.

19. The boom of claim 11, the boom further comprising:

an extension cylinder positioned within the first portion and receivable within the second portion, the extension cylinder including a hydraulic actuator operable to extend the distal end of the second portion away from the first portion and the hydraulic actuator.

20. The boom of claim 11, wherein the first portion comprises a key-shaped housing including a first housing section having a substantially circular profile and a second housing section having a substantially rectangular profile, the second housing section positioned radially outward relative to the first housing section.

* * * * *